US008407984B2

(12) United States Patent
Hashimoto et al.

(10) Patent No.: US 8,407,984 B2
(45) Date of Patent: Apr. 2, 2013

(54) VEHICLE MOUNTED ENGINE CONTROL APPARATUS

(75) Inventors: Koji Hashimoto, Chiyoda-ku (JP); Yuji Zushi, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 310 days.

(21) Appl. No.: 12/961,313

(22) Filed: Dec. 6, 2010

(65) Prior Publication Data

US 2011/0296818 A1 Dec. 8, 2011

(30) Foreign Application Priority Data

Jun. 4, 2010 (JP) ..... 2010-128437

(51) Int. Cl.
*F01N 3/00* (2006.01)

(52) U.S. Cl. ..... 60/285; 60/274; 60/286; 60/299; 60/300

(58) Field of Classification Search ..... 60/274–324; 701/103–105, 109; 123/72, 676, 697; 73/114.69, 73/114.71, 114.72, 114.73
See application file for complete search history.

(56) References Cited

U.S. PATENT DOCUMENTS 6,067,841 A * 5/2000 Suzuki et al. ..... 73/23.32
6,732,503 B2 * 5/2004 Harima et al. ..... 60/276
7,069,719 B2 7/2006 Takubo et al.
7,096,663 B2 * 8/2006 Mitsutani ..... 60/285
7,607,288 B2 * 10/2009 Miyasako et al. ..... 60/277
7,856,306 B2 * 12/2010 Nomura et al. ..... 701/109

FOREIGN PATENT DOCUMENTS

JP 06-026384 A 2/1994
JP 08-232746 A 9/1996
JP 2943508 A 2/1999
JP 2006-009652 A 1/2006
JP 4312668 A 1/2006

* cited by examiner

*Primary Examiner* — Thomas Denion
*Assistant Examiner* — Jesse Bogue
(74) *Attorney, Agent, or Firm* — Sughrue Mion, PLLC

(57) ABSTRACT

A vehicle mounted engine control apparatus serves to prevent air fuel ratio control from becoming an excessively fuel rich state by sequentially actuating heaters for early activation of a pair of exhaust gas sensors arranged in an upstream and a downstream position of a catalyzer. Electric power is first supplied to a heater for an upstream exhaust gas sensor, and the supply of electric power to a heater for a downstream exhaust gas sensor is started without waiting for activation of the upstream exhaust gas sensor, if a heater current declines to a predetermined value or less. When the upstream exhaust gas sensor is inactive, an output signal of an upstream air fuel ratio control unit inputted to a fuel injection control unit is restricted to a predetermined fuel rich command, and when the downstream exhaust gas sensor is inactive, an output signal of an downstream air fuel ratio control unit inputted to the upstream air fuel ratio control unit is restricted to a predetermined fuel rich command.

10 Claims, 12 Drawing Sheets

Imax: OVERCURRENT DETECTION THRESHOLD
Imin: DETERIORATION DETERMINATION THRESHOLD 505: OVERCURRENT ABNORMALITY DETECTION UNIT
507: DETERIORATION DETECTION UNIT
509: INACTIVITY DETERMINATION CORRECTION UNIT 602: DELAYED POWER SUPPLY TIME DETERMINATION UNIT
605: OVERCURRENT ABNORMALITY DETECTION UNIT
607: DETERIORATION DETECTION UNIT
609: INACTIVITY DETERMINATION CORRECTION UNIT

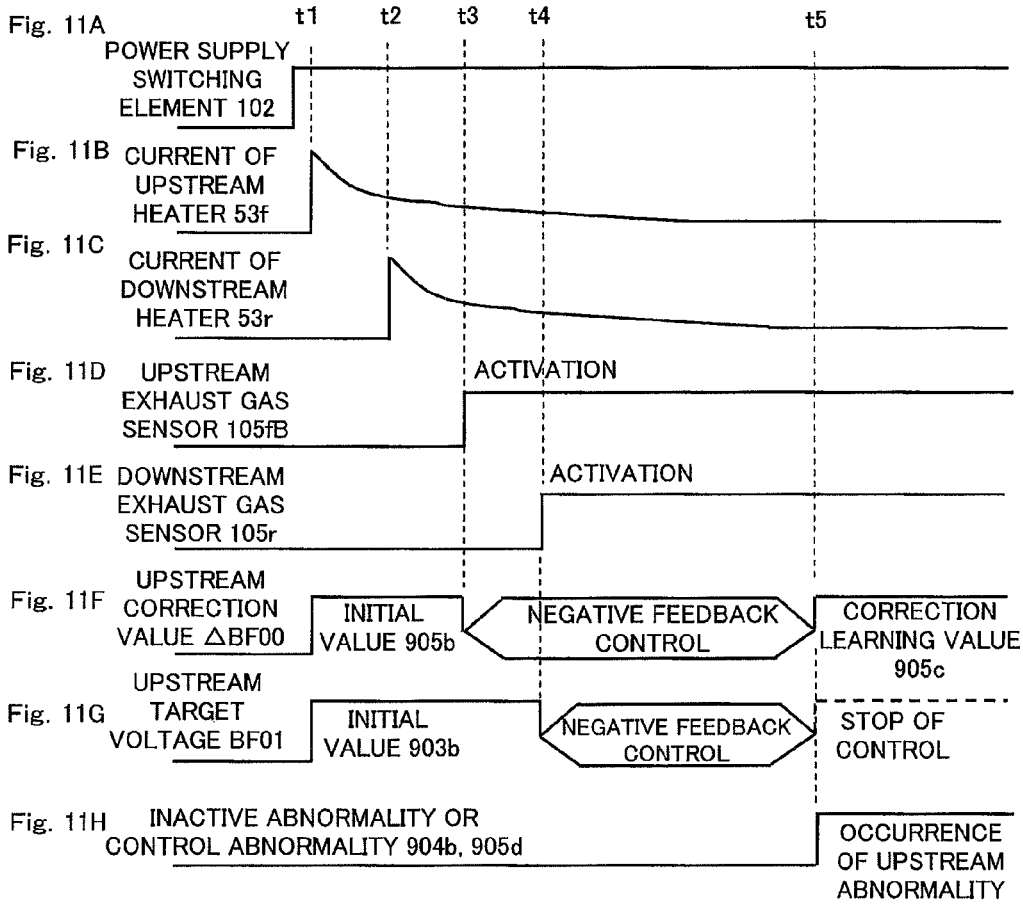
t1
t2
t3
t4
t5
Fig. 11A
POWER SUPPLY SWITCHING ELEMENT 102
Fig. 11B
CURRENT OF UPSTREAM HEATER 53f
Fig. 11C
CURRENT OF DOWNSTREAM HEATER 53r
Fig. 11D
UPSTREAM EXHAUST GAS SENSOR 105fB
ACTIVATION
Fig. 11E
DOWNSTREAM EXHAUST GAS SENSOR 105r
ACTIVATION
Fig. 11F
UPSTREAM CORRECTION VALUE ΔBF00
INITIAL VALUE 905b
NEGATIVE FEEDBACK CONTROL
CORRECTION LEARNING VALUE 905c
Fig. 11G
UPSTREAM TARGET VOLTAGE BF01
INITIAL VALUE 903b
NEGATIVE FEEDBACK CONTROL
STOP OF CONTROL
Fig. 11H
INACTIVE ABNORMALITY OR CONTROL ABNORMALITY 904b, 905d
OCCURRENCE OF UPSTREAM ABNORMALITY

VEHICLE MOUNTED ENGINE CONTROL APPARATUS

BACKGROUND OF THE INVENTION

1. Field of the Invention

The present invention relates to a vehicle mounted engine control apparatus, and in particular to an improvement in a control technique for heaters for activating exhaust gas sensors used for air fuel ratio control in a vehicle mounted engine at an early stage.

2. Description of the Related Art

In general, a vehicle mounted engine control apparatus is provided with a fuel injection control unit that controls an amount of fuel to be injected so as to obtain a target air fuel ratio by controlling a supply amount of fuel to be injected by an injector (an amount of injection fuel) in proportion to the amount of intake air detected by an air flow sensor. In addition, the vehicle mounted engine control apparatus is constructed in such a manner that the control characteristic of the air fuel ratio in the fuel injection control unit is corrected by the use of a pair of exhaust gas sensors which are arranged at locations upstream and downstream, respectively, of a catalyzer which is arranged in an exhaust passage of the internal combustion engine for removing harmful substances in an exhaust gas. Various contrivances have been made with respect to a heater control method for activating the pair of exhaust gas sensors at an early stage (for example, see a first patent document, a second patent document, and a third patent document).

According to a heater control apparatus for an air fuel ratio sensor described in the first patent document, as a heater driving requirement for reducing the electric power consumption of the upstream (front) heater and the downstream (rear) heater, for example, when the rotational speed of the internal combustion engine is 500 rpm or less or the temperature of engine cooling water is 15 degrees C. or less, it is determined that heating by means of the heaters is untimely or too early, and electric power is not supplied to any of the upstream and downstream heaters.

In addition, if the rotational speed of the engine is equal to or greater than 2,500 rpm with the cooling water temperature of the internal combustion engine being equal to or higher than 30 degrees C., or if the engine rotational speed is equal to or greater than 4,500 rpm even with the cooling water temperature being in the range of 15 through 30 degrees C. (i.e., 30 degrees C. or less), it is determined that heating by means of the heaters has already been unnecessary, and electric power is not supplied to any of the upstream and downstream heaters.

However, in cases where the rotational speed and the environmental temperature of the internal combustion engine are in a predetermined range, for example, when the engine rotational speed is 2,000 rpm or less with the cooling water temperature of the internal combustion engine being equal to or higher than 30 degrees C., or when the engine rotational speed is 4,500 rpm or less with the cooling water temperature of the internal combustion engine being in the range of 15 through 30 degrees C., electric power is supplied to both of the upstream and downstream heaters.

In addition, attention is paid to the downstream heater in which the temperature of the exhaust gas is low, and if the engine rotational speed is in the range of 2,000 through 2,500 rpm with the cooling water temperature of the internal combustion engine being equal to or higher than 30 degrees C., the supply of electric power to the upstream heater is stopped, but the supply of electric power to the downstream heater is carried out.

On the other hand, according to a control apparatus for an internal combustion engine described in the second patent document, by supplying electric power to the downstream heater at a time later than that at which electric power is supplied to the upper heater, The battery stage fright which prevents the element cracks of the downstream heater to which the moisture adheres easily according to simultaneous electric supply at the same time is prevented.

Further, according to an air fuel ratio control apparatus for an internal combustion engine described in the third patent document, a first air fuel ratio control unit, which is operated in response to an upstream oxygen concentration sensor, and a second air fuel ratio control unit, which is operated in response to a downstream oxygen concentration sensor, are arranged in a subordinate manner so that the air fuel ratio is controlled by an injector driving unit.

PRIOR ART REFERENCES

Patent Documents

[First Patent Document] Japanese patent application laid-open No. H6-26384, FIG. 9, Paragraph Nos. [0030] through [0034]

[Second Patent Document] Japanese patent application laid-open No. H8-232746, FIG. 1, Abstract

[Third Patent Document] Japanese patent application laid-open No. 2006-9652, FIG. 1, Abstract

SUMMARY OF THE INVENTION

In the conventional vehicle mounted engine control apparatuses, particularly in the case of the heater control apparatus according to the first patent document, the optimal ranges for the rotational speed and the environmental temperature of the internal combustion engine are presented as the requirements for supplying electric power to the heaters attached to the exhaust gas sensors, but there has been the following problem. That is, in the ordinary electric power supply requirements, electric power is simultaneously supplied to the upstream and downstream heaters, and hence, when the simultaneous supply of electric power is performed at a cold time of the engine, a battery voltage will drop due to inrush currents to the heaters, and in particular when the battery is in an overdischarged state, the performance of the heaters gets worse due to an abnormal voltage drop.

In addition, there has also been a problem that in cases where heater driving switching elements are arranged adjacent to one another on a circuit board, for example, the switching elements may be subjected to abnormal overheating.

On the other hand, in the case of the control apparatus for an internal combustion engine according to the second patent document, it is indicated that electric power is supplied to the downstream heater at a later time than that at which electric power is supplied to the upstream heater, so as to prevent damage to the downstream heater. In this case, the problem of the superposition of the inrush currents due to the simultaneous supply of electric power is avoided, but because delayed power supply start determining parameters are temperature information such as an exhaust gas temperature, a catalyst temperature, an engine cooling water temperature, a lubricating oil temperature, and so on, or an integrated value of the amount of fuel injection, an integrated value of the amount of intake air, and so on, there has been a problem that a delayed power supply time is uncertain and a delayed power supply start tine varies to a large extent.

Moreover, in the case of the air fuel ratio control apparatus for an internal combustion engine according to the third patent document, a multi-stage construction of the air fuel ratio control unit is presented, but no mention is made to heater control for the early activation of the exhaust gas sensors, so there has been a problem that the early activation of the exhaust gas sensors can not be achieved to a sufficient extent.

Further, any of the first through third patent documents does not disclose a technique as to how to achieve appropriate air fuel ratio control on a step by step basis from the time when both of the pair of exhaust gas sensors are in unactivated states, until the time when both of the exhaust gas sensors are eventually activated after one of the exhaust gas sensors is activated, as a result of which there has been a problem that an excessive fuel rich operation in the starting process of the internal combustion engine can not be avoided in a reliable manner.

The first object of the present invention is to provide a vehicle mounted engine control apparatus which is capable of preventing the overdischarge and abnormal voltage drop of a vehicle mounted battery and at the same time capable of activating both of upstream and downstream exhaust gas sensors at a time as early as possible while preventing the abnormal overheating of switching elements.

The second object of the present invention is to provide a vehicle mounted engine control apparatus which is capable of achieving normal air fuel ratio control at a time as early as possible by performing shift control on a step by step basis from the time when both of a pair of exhaust gas sensors are in unactivated states, until the time when both of the exhaust gas sensors are eventually activated after one of the exhaust gas sensors is activated.

A vehicle mounted engine control apparatus according to the present invention, to which are connected a rotation sensor that generates a pulse signal corresponding to the rotational speed of an internal combustion engine, an air flow sensor or a negative pressure sensor that is arranged in an intake passage of the internal combustion engine, a pair of upstream and downstream exhaust gas sensors that are arranged in an upstream position and a downstream position of a catalyzer which is arranged in an exhaust passage of the internal combustion engine, and each generate a nonlinear or linear detection signal voltage corresponding to an air fuel ratio of an exhaust gas in the exhaust passage, and a pair of upstream and downstream heaters to which electric power is supplied at the time when a predetermined requirement is satisfied, in order to activate the upstream and downstream exhaust gas sensors at an early stage, is provided with:

a microprocessor that cooperates with a program memory to execute a fuel injection control unit, an upstream air fuel ratio control unit and a downstream air fuel ratio control unit; and a heater control circuit that includes a pair of upstream and downstream switching elements which are driven and controlled by the microprocessor so as to supply electric power to the upstream and downstream heaters, and a pair of current sensing resistors for supplying heater current detection signals to the microprocessor.

The fuel injection control unit adjusts the valve opening time of an injector, which is an electromagnetic coil for driving a fuel injection electromagnetic valve, thereby to control an amount of fuel injection, in proportion to an amount of intake air, which is detected by the air flow sensor, or arithmetically calculated from the rotational speed of the internal combustion engine and the detection value of the negative pressure sensor, and controls an amount of fuel supply in such a manner that a predetermined voluntary target air fuel ratio can be obtained.

The upstream air fuel ratio control unit generates to the fuel injection control unit a correction command to increase or decrease the amount of fuel supply in such a manner that the air fuel ratio in the upstream position corresponding to the detection signal voltage obtained from the upstream exhaust gas sensor matches a first target voltage which is a target air fuel ratio in the upstream position.

The downstream air fuel ratio control unit corrects the first target voltage in such a manner that the air fuel ratio in the downstream position corresponding to the detection signal voltage obtained from the downstream exhaust gas sensor matches a second target voltage which is a target air fuel ratio in the downstream position.

At the time when a supply current to the upstream heater declines to a predetermined value or less in accordance with a temperature rise of the upstream heater to which electric power has first been supplied, the supply of electric power to the downstream heater is started even if the upstream exhaust gas sensor is still in an unactivated state.

The value of the voluntary target air fuel ratio of the fuel injection control unit is set to a first initial value in which the exhaust gas becomes a fuel rich state, until the resistance value of an internal resistance of the upstream exhaust gas sensor decreases to generate an upstream side detection signal voltage.

The first target voltage to the upstream air fuel ratio control unit is set to a second initial value in which the exhaust gas becomes a fuel rich state, until the resistance value of an internal resistance of the downstream exhaust gas sensor decreases to generate a downstream side detection signal voltage.

According to the vehicle mounted engine control apparatus of this invention, for the fuel injection control unit which controls the amount of fuel injection so that the amount of fuel to be supplied by the injector is controlled in proportion to the detected amount of intake air thereby to obtain a target air fuel ratio, the target air fuel ratio is corrected based on air fuel ratio information obtained from the pair of exhaust gas sensors arranged in the upstream and downstream positions of the catalyzer which purifies the exhaust gas. In addition, the supply of electric power to the downstream heater for activating the downstream exhaust gas sensor at an early stage is started at the time when the supply current to the upstream heater declines to the predetermined value or less. Moreover, until the exhaust gas sensors are activated, fuel injection control is carried out in such a manner that an air fuel ratio can be obtained based on a predetermined initial value in which the exhaust gas becomes a fuel rich state.

As a result of this, at the time of cold start of the engine in which the voltage of a vehicle mounted battery has dropped abnormally, priority is first given to the activation of the upstream exhaust gas sensor, and at the same time, the supply of electric power to the heater of the downstream exhaust gas sensor is also started even if the upstream exhaust gas sensor is still in an unactivated state, so normal operation of the engine can be started promptly as a whole.

In addition, even when the vehicle mounted battery is not in an overdischarged state, it is possible to prevent electric power from being supplied to the upstream and downstream heaters at the same time, and hence the flow of resultant excessive inrush current, as a result of which it is also possible to prevent reduction of the heating capability of the heaters due to the drop of the battery voltage as well as abnormal overheating of the upstream and the downstream switching elements.

Moreover, until the exhaust gas sensors have been activated, the engine is operated in a condition in which the exhaust gas becomes a fuel rich state, and hence, a determination as to the activation of the exhaust gas sensors can be made by detecting a change in the detection signal voltages.

BRIEF DESCRIPTION OF THE DRAWINGS

FIGS. 11A through 11H are timing charts showing a heater control operation according to the second embodiment of the present invention.

BEST MODES FOR CARRYING OUT THE INVENTION

Hereinafter, preferred embodiments of the present invention will be described in detail while referring to the accompanying drawings.

First Embodiment

First of all, a first embodiment of the present invention will be explained below with reference to FIG. 1 through FIG. 7.

Figure 1:
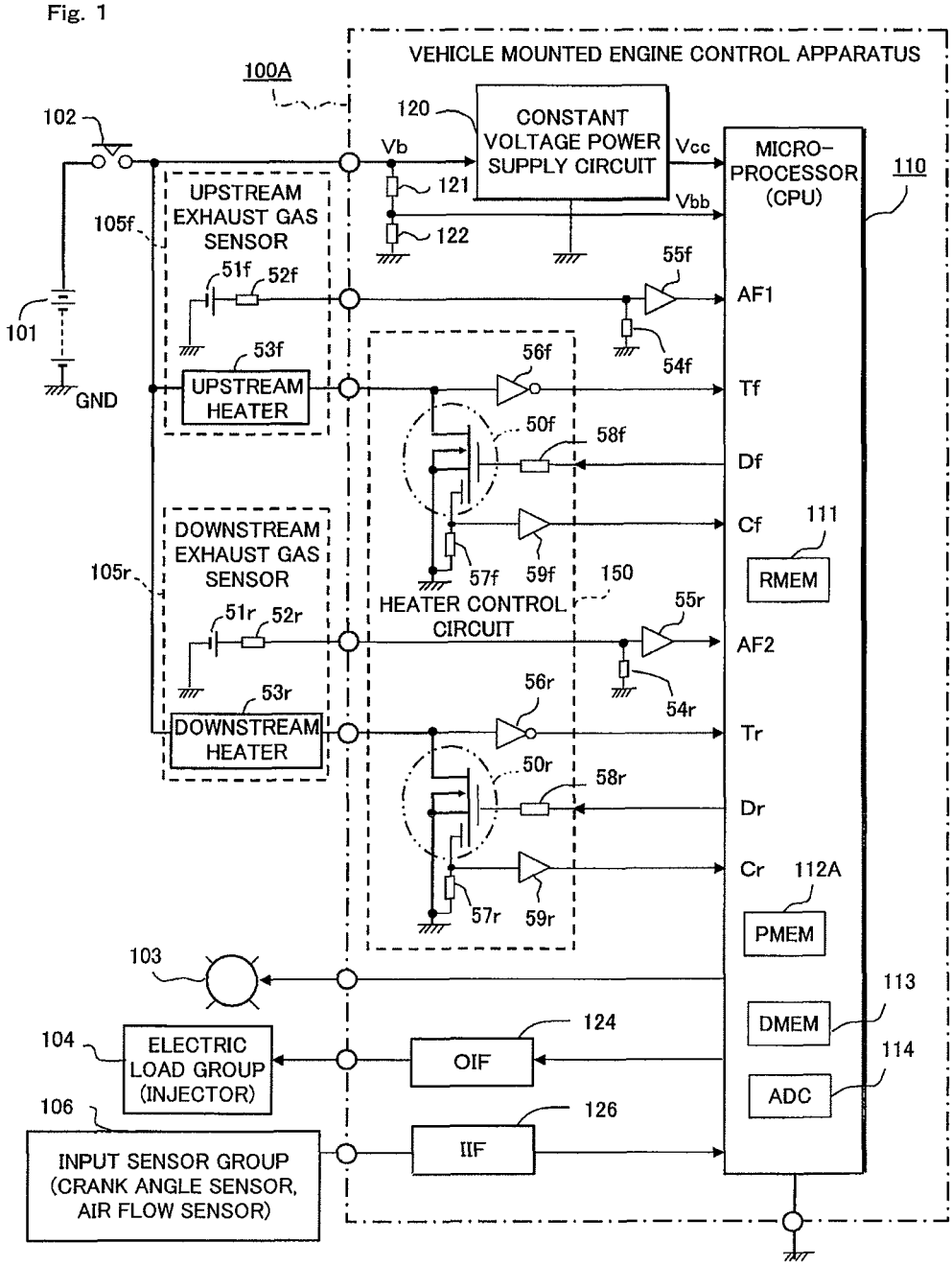
FIG. 1 is a circuit block diagram showing the overall construction of a vehicle mounted engine control apparatus according to a first embodiment of the present invention.
Figure 2B:
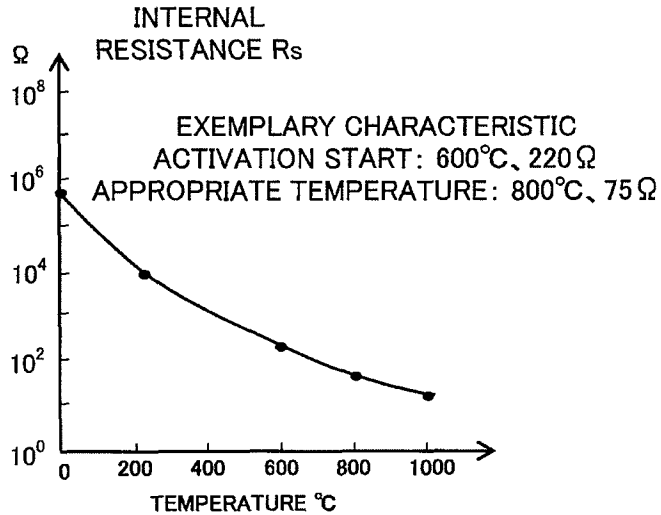
FIGS. 2A and 2B are explanatory views showing characteristic curves of a nonlinear type exhaust gas sensor used in the present invention.
Figure 2A:
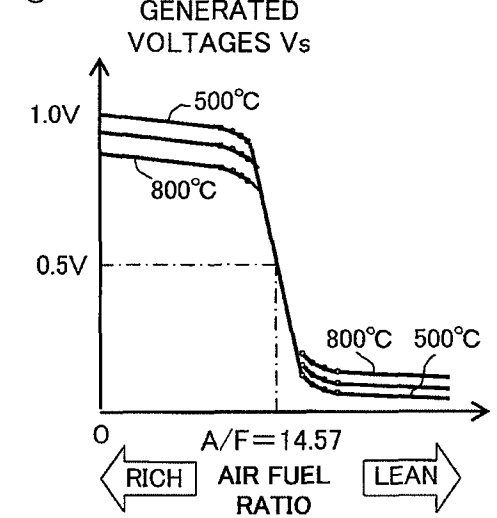
Figure 3A:
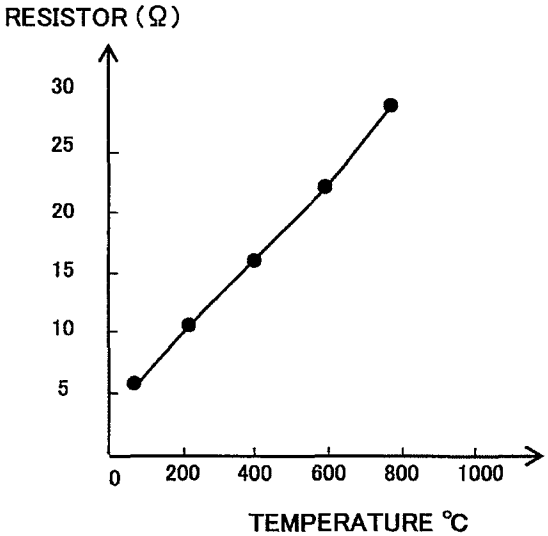
FIGS. 3A and 3B are explanatory views showing characteristic curves of a heater for heating the exhaust gas sensor used in the present invention.
Figure 3B:
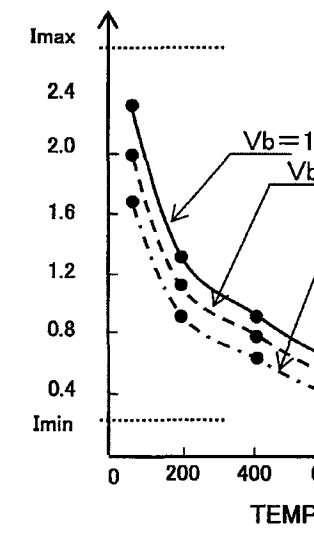

FIG. 1 is a circuit block diagram which shows the overall construction of a vehicle mounted engine control apparatus 100A according to the first embodiment of the present invention. In addition, FIGS. 2A and 2B are explanatory views which show characteristic curves of a nonlinear type exhaust gas sensor used in the present invention, and FIGS. 3A and 3B are explanatory views which show characteristic curves of a heater for heating an exhaust gas sensor used in the present invention.

In FIG. 1, the vehicle mounted engine control system 100A is provided with a microprocessor (CPU) 110 that constitutes a main part of the vehicle mounted engine control system 100A, a constant voltage power supply circuit 120 that performs the supply of electric power to the microprocessor 110, voltage dividing resistors 121, 122 for supervising an input voltage to the constant voltage power supply circuit 120, an output interface circuit (OIF) 124, an input interface circuit (IIF) 126, a heater control circuit 150 that controls a pair of upstream and downstream exhaust gas sensors 105*f*, 105*r*, and a pair of reduction resistors 54*f*, 54*r* and a pair of amplifiers 55*f*, 55*r* for inputting air fuel ratio detection signal voltages (hereinafter, referred to simply as "detection signal voltages") AF1, AF2 from the upstream and downstream exhaust gas sensors 105*f*, 105*r* to the microprocessor 110.

The vehicle mounted engine control apparatus 100A is supplied with electric power from an external power supply (vehicle mounted battery) 101 through a power supply switching element 102 which is operated in response to a power switch (not shown) such as a key switch, etc.

Connected to the vehicle mounted engine control apparatus 100A are an alarm indicator 103, an electric load group 104 of a large number of electric loads including at least an injector (an electromagnetic coil of a fuel injection electromagnetic valve to be described later), an upstream heater 53*f* attached to the upstream exhaust gas sensor 105*f*, and a downstream heater 53*r* attached to the downstream exhaust gas sensor 105*r*, so that these components are driven under the control of the vehicle mounted engine control apparatus 100A.

In addition, also connected to the vehicle mounted engine control apparatus 100A are the upstream exhaust gas sensor 105*f* that is composed of an equivalent voltage source 51*f* and an internal resistance 52*f*, the downstream exhaust gas sensor 105*r* that is composed of an equivalent voltage source 51*r* and an internal resistance 52*r*, and an input sensor group 106 of various kinds of input sensors including at least an air flow sensor and a crank angle sensor (to be described later), so that the vehicle mounted engine control apparatus 100A operates to supply or stop electric power to the electric load group 104 and the upstream and downstream heaters 53*f*, 53*r* in response to the operating states of these input sensors.

The microprocessor (CPU) 110, which constitutes a main part of the vehicle mounted engine control system 100A, is provided with a RAM memory (RMEM) 111 for arithmetic processing, a program memory (PMEM: for example, a nonvolatile flash memory) 112A, a data memory (DMEM: for example, a nonvolatile EEPROM memory) 113, and a multi-channel AD converter (ADC) 114, wherein the microprocessor 110 functions in cooperation with these components.

The detection signals of analog sensors included in the input sensor group 106 are inputted to the microprocessor 110 through the multi-channel AD converter 114.

The program memory 112A stores therein an input and output control program for the input sensor group 106 and the electric load group 104, and also stores, in addition thereto, control programs for the upstream and downstream exhaust gas sensors 105*f*, 105*r* and the upstream and downstream heaters 53*f*, 53*r*. Here, note that the details of the respective control programs will be described later, together with FIG. 5 through FIG. 7.

The nonvolatile data memory 113 stores therein learning storage information and abnormality occurrence history information on the input sensor group 106 and the electric load group 104, and also stores, in addition thereto, learning storage information and abnormality occurrence history information on the upstream and downstream exhaust gas sensors 105*f*, 105*r* and the upstream and downstream heaters 53*f*, 53*r*.

The constant voltage power supply circuit 120 generates a stabilized control power supply voltage (for example, DC5 [V]) Vcc from a drive power supply voltage Vb applied thereto from the external power supply 101 through the power supply switching element 102, and supplies it to the microprocessor 110 as a control voltage.

The voltage dividing resistors 121, 122 connected in series with each other input a divided voltage of the drive power supply voltage Vb to the microprocessor 110 as a supervisory power supply voltage Vbb.

The electric load group 104 has, as its main components, power transistors of ignition coils or electromagnetic valves for gear ratio selection of a speed change gear (transmission), for example, in addition to the fuel injection electromagnetic valve, and is connected to an output port of the microprocessor 110 through the output interface circuit 124.

The input sensor group 106 has, as its main components, a filter circuit such as the upstream and downstream exhaust gas sensors 105*f*, 105*r*, an accelerator position sensor, and a throttle position sensor, etc., in addition to the engine crank angle sensor and the air flow sensor, and is connected to an input port of the microprocessor 110 through the input interface circuit 126.

The heater control circuit 150 is constructed as a power module including an upstream switching element 50*f* and a downstream switching element 50*r*, and is further provided with inverting logic elements 56*f*, 56*r*, current sensing resistors 57*f*, 57*r*, drive resistors 58*f*, 58*r*, and amplifiers 59*f*, 59*r*.

The upstream and downstream switching elements 50*f*, 50*r* in the heater control circuit 150 are composed of N channel type field-effect transistors, and drive the upstream and downstream heaters 53*f*, 53*r* in the upstream and downstream exhaust gas sensors 105*f*, 105*r* under the control of the microprocessor 110.

Specifically, when the logic levels of heater driving commands Df, Dr generated from the microprocessor 110 are "H (high)", the upstream and downstream switching elements 50*f*, 50*r* are driven to conductive states through the drive resistors 58*f*, 58*r*.

An electric potential at a connection point between the upstream heater 53*f* and the upstream switching element 50*f* and an electric potential at a connection point between the downstream heater 53*r* and the downstream switching element 50*r* are inverted through the inverting logic elements 56*f*, 56*r* into logic supervisory signals Tf, Tr, respectively, which are then inputted to the microprocessor 110.

Voltages across the opposite ends of the current sensing resistors 57*f*, 57*r*, which are arranged in current mirror circuits of the upstream and downstream switching elements 50*f*, 50*r*, respectively, are turned through the amplifiers 59*f*, 59*r* into heater current detection signals Cf, Cr, respectively, which are then inputted to the microprocessor 110.

Here, note that a part, e.g., 1/100, of current, which flows from a drain terminal of each of the upstream and downstream switching elements 50*f*, 50*r* to a source terminal thereof, flows through the corresponding current sensing resistor 57*f* or 57*r*.

Voltages Vs generated from the equivalent voltage sources 51*f*, 51*r* in the upstream and downstream exhaust gas sensors 105*f*, 105*r*, respectively, are supplied to the reduction resistors 54*f*, 54*r* in the vehicle mounted engine control apparatus 100A through the internal resistances 52*f*, 52*r*, respectively.

Voltages across the opposite ends of the reduction resistors 54*f*, 54*r*, respectively, are turned through the amplifiers 55*f*, 55*r* into detection signal voltages AF1, AF2, respectively, which are then inputted to the microprocessor 110.

In FIGS. 2A and 2B (the characteristics of each of the upstream and downstream exhaust gas sensors 105*f*, 105*r*), FIG. 2A shows the characteristic of an air fuel ratio detection signal, wherein the axis of abscissa represents the air fuel ratio A/F of an exhaust gas, and the axis of ordinate represents the generated voltage Vs of each of the equivalent voltage sources 51*f*, 51*r* in the upstream and downstream exhaust gas sensors 105*f*, 105*r*.

With an amount of air of 14.57 [gr] (i.e., stoichiometric air fuel ratio A/F=14.57) required for complete combustion of gasoline of 1 [gr] being as a threshold, if fuel is richer than that at the threshold, the generated voltage Vs of each of the equivalent voltage sources 51*f*, 51*r* will be saturated to a value of about 1 [V], and if fuel is leaner than that at the threshold, the generated voltage Vs will be saturated to a value of about 0 [V].

In general, an exhaust gas sensor having a nonlinear output characteristic, as shown in FIG. 2A, is called a lambda type exhaust gas sensor.

FIG. 2B shows a temperature characteristic of each of the internal resistances 52*f*, 52*r*, wherein the axis of abscissa represents the internal temperature of each of the upstream and downstream exhaust gas sensors 105*f*, 105*r*, and the axis of ordinate represents the resistance value Rs of each of the internal resistances 52*f*, 52*r*.

The internal resistances 52*f*, 52*r* have a negative temperature characteristic in which the resistance value Rs of each of the internal resistances 52*f*, 52*r* becomes equal to or greater than several MΩ in a cold time, but it decreases to about 220Ω at an activation start temperature of 600 degrees C. of the upstream and downstream exhaust gas sensors 105*f*, 105*r*, and further, it decreases to a value of about 75Ω at a proper temperature of 800 degrees C.

Assuming that the amplification factor G of each of the amplifiers 55*f*, 55*r* is set to "1", the voltage value Vaf of each of the detection signal voltages AF1, AF2 is represented as shown in the following equation (1), by using the generated voltage Vs of each of the equivalent voltage sources 51*f*, 51*r*, the resistance value Rs of each of the internal resistances 52*f*, 52*r*, and the resistance value Rd of each of the reduction resistors 54*f*, 54*r*.

$$Vaf=Vs\times Rd/(Rd+Rs) \quad (1)$$

In equation (1) above, Rs is by far greater than Rd (i.e., Rs>>Rd) in the cold time, so Vaf becomes approximately zero (i.e., Vaf≈0) as it is, but due to exhaust heat and heating from the upstream and downstream heaters 53*f*, 53*r*, the internal temperature of each of the upstream and downstream exhaust gas sensors 105*f*, 105*r* rises, and the internal resistance value Rs decreases.

Thereafter, if Rs becomes by far smaller than Rd (i.e., Rs<<Rd), Vaf will be approximately equal to Vs (i.e., Vaf≈Vs), and if the exhaust gas is in a fuel rich state, the voltage value Vaf of each of the detection signal voltages AF1, AF2 will exceed the predetermined threshold, so it can be determined that the activation of each of the upstream and downstream exhaust gas sensors 105*f*, 105*r* has been completed.

In FIGS. 3A and 3B (the characteristics of each of the upstream and downstream heaters 53*f*, 53*r*), FIG. 3A shows the temperature characteristic of each heater resistance Rh, wherein the axis of abscissa represents the temperature of each of the upstream and downstream heaters 53*f*, 53*r* themselves, and the axis of ordinate represents the value of the heater resistance Rh.

As is clear from FIG. 3A, the heater resistance Rh has a positive temperature coefficient which increases in accordance with rising temperature.

FIG. 3B shows the supply current characteristic of a heater current Ih, wherein the axis of abscissa represents the temperature of each of the upstream and downstream heaters 53*f*, 53*r* themselves, and the axis of ordinate represents the value of the heater current Ih.

As is clear from FIG. 3B, the supply current characteristic of the heater current Ih is changed according to the values (10 [V], 12 [V], 14 [V]) of the drive power supply voltage Vb.

In addition, in the supply current characteristic of FIG. 3B, there are shown an overcurrent determination threshold Imax for overcurrent detection in overcurrent abnormality detection units 505, 605 (to be described later together with FIG. 5 and FIG. 6) and a deterioration determination threshold Imin for deterioration abnormality detection in deterioration detection units 507, 607 (to be described later together with FIG. 5 and FIG. 6).

However, the value of the deterioration determination threshold Imin is set so as to increase in proportion to the value of the drive power supply voltage Vb.

Figure 4:
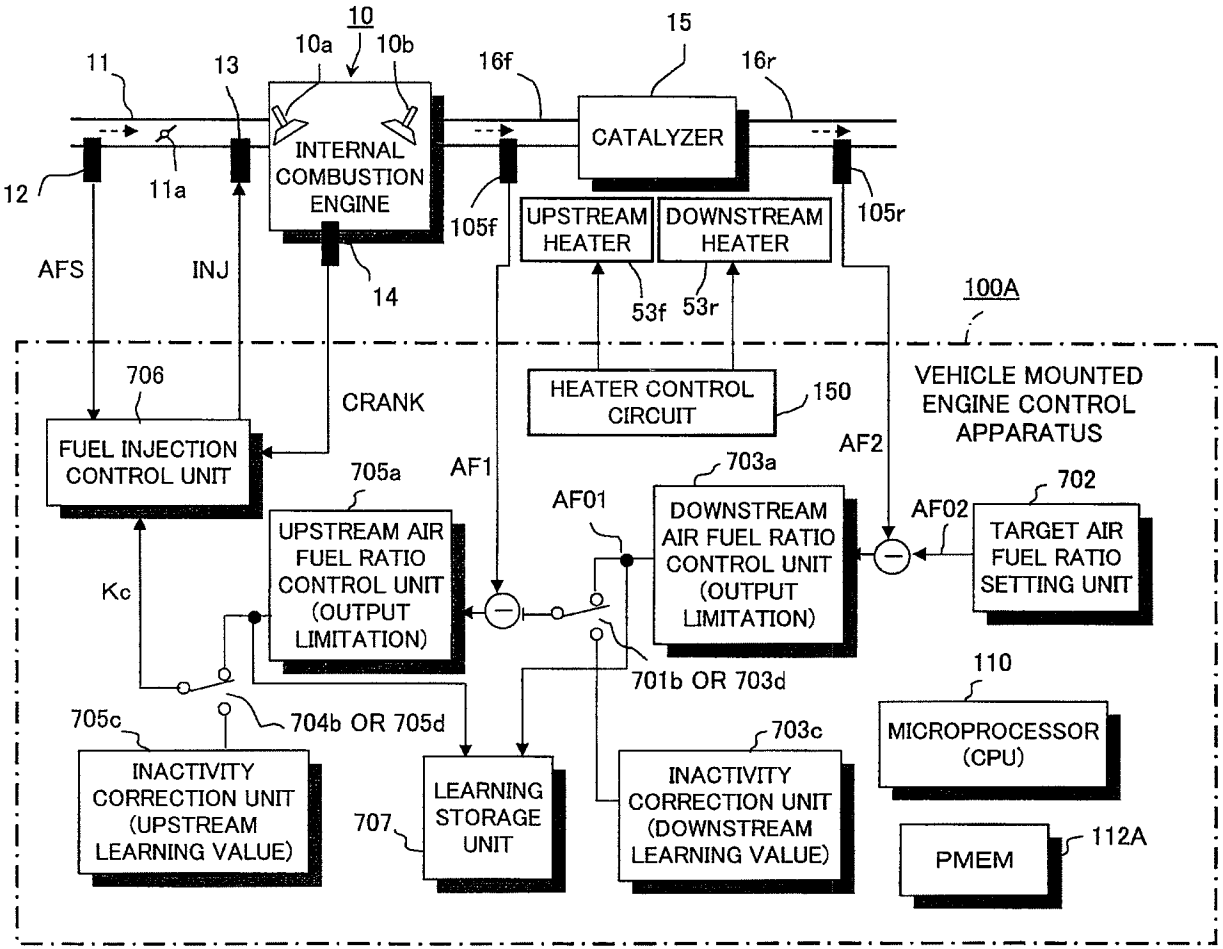
FIG. 4 is a functional block diagram showing the essential parts of the vehicle mounted engine control apparatus according to the first embodiment of the present invention, together with an engine construction.
Figure 7:
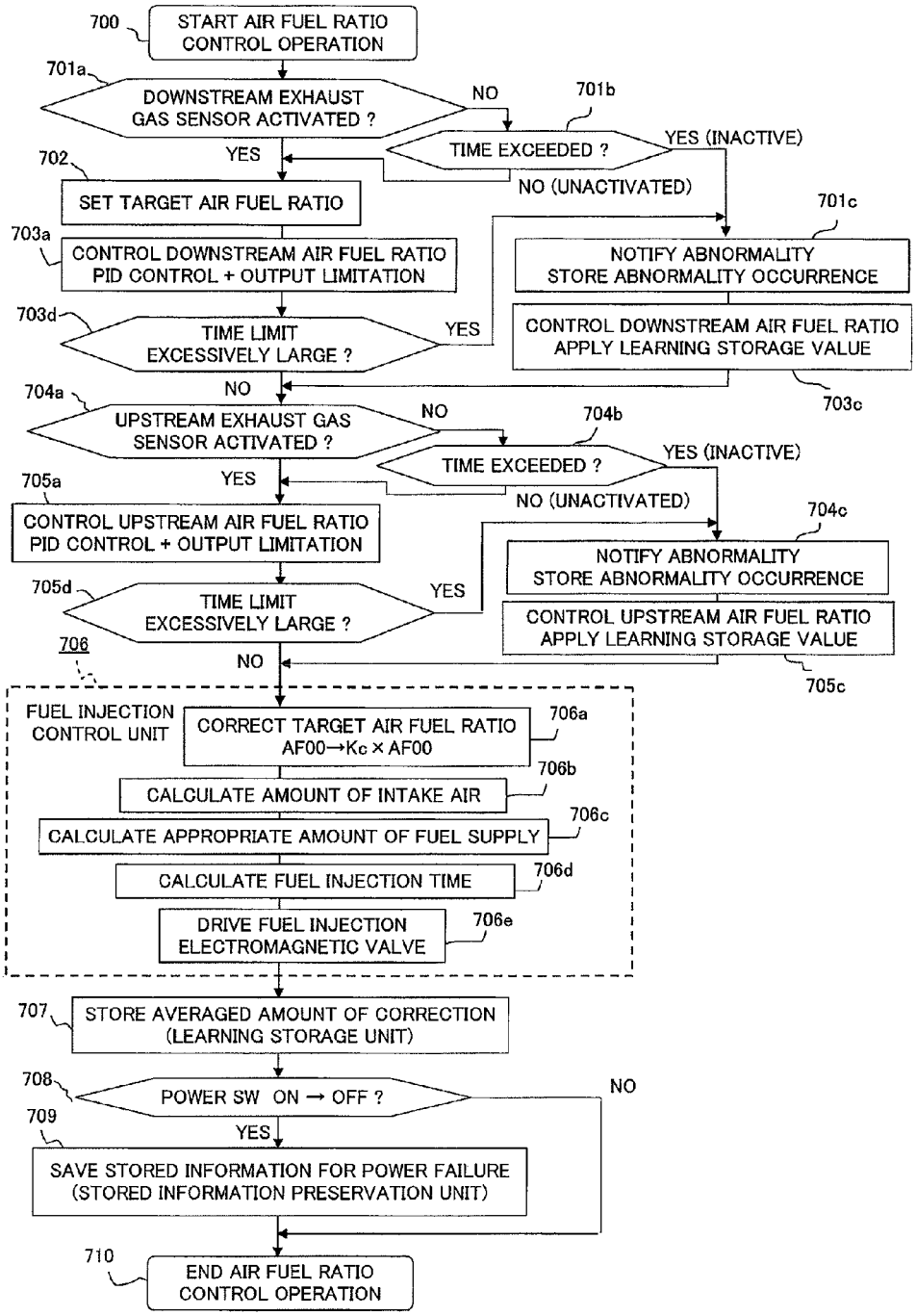
FIG. 7 is a flow chart for explaining an air fuel ratio control operation according to the first embodiment of the present invention.

FIG. 4 is a functional block diagram showing the essential parts of the vehicle mounted engine control apparatus 100A according to the first embodiment of the present invention, together with an engine construction, wherein the main functions of the vehicle mounted engine control apparatus 100A in FIG. 1 are shown in a simplified manner by being corresponded to the respective processing units in FIG. 7.

In FIG. 4, the vehicle mounted engine control apparatus 100A is provided, in addition to the microprocessor (CPU) 110, the program memory (PMEM) 112A and the heater control circuit 150, with a target air fuel ratio setting unit 702, a downstream air fuel ratio control unit 703*a*, an inactivity correction unit 703*c* using a downstream learning value, an upstream air fuel ratio control unit 705*a*, an inactivity correction unit 705*c* using an upstream learnt value, a fuel injection control unit 706, and a learning storage unit 707.

In addition, the vehicle mounted engine control apparatus 100A is provided with an inactive abnormality detection unit 701*b* or a control abnormality detection unit 703*d* related to input information of the upstream air fuel ratio control unit 705*a*, and an inactive abnormality detection unit 704*b* or a control abnormality detection unit 705*d* related to input information of the fuel injection control unit 706.

On the other hand, an intake pipe 11 is arranged in communication with an internal combustion engine 10 through an intake valve 10*a*, and upstream and downstream exhaust pipes 16*f*, 16*r* are arranged in communication with the internal combustion engine 10 through an exhaust valve 10*b*.

An injector 13 for fuel injection is arranged immediately before or immediately after the intake valve 10*a* of the internal combustion engine 10, and at the same time, a crank angle sensor 14 (rotation sensor) for rotational position detection is mounted on a crankshaft (not shown) of the internal combustion engine 10.

A catalyzer or catalytic converter 15 for removing harmful substances in an exhaust gas is arranged in an exhaust passage between the upstream and downstream exhaust pipes 16*f*, 16*r* of the internal combustion engine 10.

In addition, the individual the upstream and downstream exhaust gas sensors 105*f*, 105*r* are arranged in the upstream and downstream exhaust pipes 16*f*, 16*r*, respectively, and the individual upstream and downstream heaters 53*f*, 53*r* are arranged in the vicinity of the upstream and downstream exhaust gas sensors 105*f*, 105*r*, respectively.

In other words, the upstream exhaust gas sensor 105*f* having the heater 53*f* is arranged at a location upstream of the catalyzer 15, and the downstream exhaust gas sensor 105*r* having the heater 53*r* is arranged at a location downstream of the catalyzer 15.

An air flow sensor 12 is arranged in a top end portion of the intake pipe 11, and a throttle butterfly 11*a* is arranged in a downstream portion of the intake pipe 11.

An amount of intake air Qa sucked into the internal combustion engine 10 is adjusted by the degree of valve opening of the throttle butterfly 11*a* which is operated in response to the degree of depression of an accelerator pedal (not shown).

Here, the amount of intake air Qa [gr] per cycle and per cylinder of the four-cylinder, four-cycle internal combustion engine 10 is represented as shown in the following equation (2) by the use of the engine rotational speed N [rps] of the internal combustion engine 10, which is calculated by the reciprocal of the interval of generation (or the frequency of generation) of the pulse signal from the crank angle sensor 14, and the amount of intake air per second q [gr/sec], which is detected by the air flow sensor 12.

$$Qa=q/(2\times N) \tag{2}$$

Here, note that the amount of intake air per second q [gr/sec] is calculated from the value of the amount of intake air detected from the air flow sensor 12.

Specifically, the volume of intake air per second is calculated by multiplying the air speed [m/sec] detected by means of the air flow sensor 12 by the cross section of the intake pipe 11, and in addition, the intake air volume thus obtained is converted into an amount of intake air q [gr/sec] per second by being multiplied by an air weight of 1.3 [gr/liter].

In addition, the amount of fuel (the amount of fuel injection) F to be supplied by one valve opening operation of the injector 13 is represented as shown in the following equation (3) by the use of an amount of fuel injection per second [gr/sec], which is determined from the fuel pressure by a fuel pump and an aperture (bore diameter) of the injector 13, and a valve opening time ΔT of the injector 13.

$$F=f\times\Delta T \tag{3}$$

On the other hand, assuming that voluntary target air fuel ratio AF00 is set to Qa/F (i.e., AF00=Qa/F), the following equation (4) will be obtained from the aforementioned equations (2) and (3).

$$\begin{aligned}\Delta T &= F/f \\ &= Qa/(f\times AF00) \\ &= q/(2\times f\times N\times AF00) \\ &= K\times q/N\end{aligned} \tag{4}$$

However, in equation (4) above, a control parameter K is represented as shown in the following equation (5).

$$K=0.5/(f\times AF00) \tag{5}$$

As is clear from equation (4) above, the valve opening time ΔT of the injector 13 becomes a value which is proportional to the amount of intake air per second q detected by means of the air flow sensor 12, and which is in inverse proportion to the rotational speed N of the internal combustion engine 10.

However, a variety of kinds of variation factors are inherent in the control parameter K, so negative feedback control using the upstream and downstream exhaust gas sensors 105*f*, 105*r* is carried out.

Although the vehicle mounted engine control apparatus 100A provided with the microprocessor 110 and the program memory 112A performs the control of electric power supplied to the upstream and downstream heaters 53*f*, 53*r* by means of the heater control circuit 150 and the control programs stored in the program memory 112A, as stated above, the detailed operation thereof will be described later together with FIG. 5 and FIG. 6.

The program memory 112A in the vehicle mounted engine control apparatus 100A further stores an air fuel ratio control program, so that it performs a control operation on the air fuel ratio (to be described later together with FIG. 7).

The fuel injection control unit 706 controls the amount of fuel (the amount of fuel injection) F to be supplied by the injector 13 in such a manner that the amount of fuel injection F is proportional to the amount of intake air per second q detected by the air flow sensor 12 of the equation (4) and in inverse proportion to the engine rotational speed N. In this manner, the fuel injection control unit 706 primarily operates so that the independent or voluntary target air fuel ratio AF00 can be obtained.

The upstream air fuel ratio control unit 705*a* generates an air fuel ratio correction coefficient Kc for correcting the voluntary target air fuel ratio AF00 of the fuel injection control unit 706 in such a manner that the air fuel ratio in an upstream position corresponding to an average value of the air fuel ratio detection signal (detection signal voltage) AF1 of the upstream exhaust gas sensor 105*f* matches a first target voltage AF01 which is a target air fuel ratio in the upstream position. The value of the air fuel ratio correction coefficient Kc serves as a correction command to increase or decrease the amount of fuel F to be supplied (hereinafter referred to as the amount of fuel supply F).

The downstream air fuel ratio control unit 703*a* corrects the first target voltage AF01 in such a manner that the air fuel ratio in a downstream position corresponding to an average value of the detection signal voltage AF2 of the downstream exhaust gas sensor 105*r* matches a second target voltage AF02 which is a target air fuel ratio in the downstream position.

The air fuel ratio correction coefficient Kc inputted to the fuel injection control unit 706 is set to a first initial value in which the exhaust gas becomes a fuel rich state, until the resistance value Rs of the internal resistance 52*f* of the upstream exhaust gas sensor 105*f* decreases to generate the upstream side detection signal voltage AF1.

In addition, the first target voltage AF01 inputted to the upstream air fuel ratio control unit 705*a* is set to a second initial value in which the exhaust gas becomes a fuel rich state, until the resistance value Rs of the internal resistance 52*r* of the downstream exhaust gas sensor 105*r* decreases to generate the downstream side detection signal voltage AF2.

The upstream air fuel ratio control unit 705*a* is composed of a first digital filter circuit for a deviation voltage between the first target voltage AF01 and the detection signal voltage AF1, and a first PID regulation circuit.

In the upstream air fuel ratio control unit 705*a*, the output voltage of the first PID regulation circuit has its upper limit restricted so as not to be a rich command output in which the output voltage is equal to or larger than a first upper limit value, and the first upper limit value is the first initial value for the fuel injection control unit 706 at the time when the upstream exhaust gas sensor 105*f* is in its unactivated state.

In addition, the downstream air fuel ratio control unit 703*a* is composed of a second digital filter circuit for a deviation voltage between the second target voltage AF02 and the detection signal voltage AF2, and a second PID regulation circuit.

In the downstream air fuel ratio control unit 703*a*, the output voltage of the second PID regulation circuit has its upper limit restricted so as not to be a rich command output in which the output voltage is equal to or larger than a second upper limit value, and the second upper limit value is the second initial value for the upstream air fuel ratio control unit 705*a* at the time when the downstream exhaust gas sensor 105*r* is in its unactivated state.

Here, note that the deviation voltage between the second target voltage AF02 and the detection signal voltage AF2 may be calculated by smoothing the detection signal voltage AF2 by the second digital filter circuit to obtain an average value, which is then subtracted by the second target voltage AF02, but it is desirable to calculate the deviation voltage between the second target voltage AF02 and the detection signal voltage AF2 beforehand, and to perform smoothing processing thereon by means of a digital circuit to obtain an average value.

The inactive abnormality detection unit 701*b* makes a determination that the downstream exhaust gas sensor 105*r* is in a state of inactive abnormality, in the case of detecting that the detection signal voltage AF2 of the downstream exhaust gas sensor 105*r* does not change from an L (low) level to an H (high) level even if a predetermined determination time has passed after electric power is supplied to the downstream heater 53*r*.

In response to the inactive abnormality detection unit 701*b* having detected the inactive abnormality state of the downstream exhaust gas sensor 105*r*, the inactivity correction unit 703*c* inputs a predetermined alternative signal voltage, in place of the first target voltage AF01 generated by the downstream air fuel ratio control unit 703*a*, to the upstream air fuel ratio control unit 705*a*.

The inactive abnormality detection unit 704*b* makes a determination that the upstream exhaust gas sensor 105*f* is in a state of inactive abnormality, in the case of detecting that the detection signal voltage AF1 of the upstream exhaust gas sensor 105*f* does not change from an L (low) level to an H (high) level even if a predetermined determination time has passed after electric power is supplied to the upstream heater 53*f*.

In response to the inactive abnormality detection unit 704*b* having detected the inactive abnormality state of the upstream exhaust gas sensor 105*f*, the inactivity correction unit 705*c* inputs a predetermined alternative signal voltage, in place of the air fuel ratio correction coefficient Kc generated by the upstream air fuel ratio control unit 705*a*, to the fuel injection control unit 706.

In cases where the state in which the output (the first target voltage AF01) generated by the downstream air fuel ratio control unit 703*a* is out of a predetermined upper and lower limit range continues over a predetermined time or more, the control abnormality detection unit 703*d* makes a determination that the downstream air fuel ratio control unit 703*a* is abnormal.

Further, in response to the control abnormality detection unit 703*d* having detected the abnormal state of the downstream air fuel ratio control unit 703*a*, the inactivity correction unit 703*c* inputs a predetermined alternative signal voltage, in place of the first target voltage AF01 generated by the downstream air fuel ratio control unit 703*a*, to the upstream air fuel ratio control unit 705*a*.

In cases where the state in which the output (the air fuel ratio correction coefficient Kc) generated by the upstream air fuel ratio control unit 705*a* is out of a predetermined upper and lower limit range continues over a predetermined time or more, the control abnormality detection unit 705*d* makes a determination that the upstream air fuel ratio control unit 705*a* is abnormal.

In response to the control abnormality detection unit 705*d* having detected the abnormal state of the upstream air fuel ratio control unit 705*a*, the inactivity correction unit 705*c* inputs a predetermined alternative signal voltage, in place of the air fuel ratio correction coefficient Kc generated by the upstream air fuel ratio control unit 705*a*, to the fuel injection control unit 706.

Here, note that when a fuel cut is carried out in a coasting operation or a downhill (descending) operation, a fuel cut detection unit (not shown) is operated in place of the control abnormality detection units 703*d*, 705*d*, so that an air fuel ratio control operation is stopped.

The program memory 112A is provided with a control program which serves as a learning storage unit 707, and the learning storage unit 707 stores an average value of a plurality of latest output values (first target voltages AF01 or air fuel ratio correction coefficients Kc) of the downstream air fuel ratio control unit 703*a* or the upstream air fuel ratio control unit 705*a*, which have been stored in a sequential manner, corresponding to at least one of the amount of intake air Qa and the rotational speed N of the internal combustion engine 10.

An average value of measured data, which have been learned and stored by the learning storage unit 707 during the time when the downstream and upstream exhaust gas sensors 105*r*, 105*f* are operating in a normal manner, is applied as the alternative signal voltages generated from the inactivity correction units 703*c*, 705*c*.

Next, reference will be made to an operation according to the first embodiment of the present invention as shown in FIG. 1.

In FIG. 1, first, when a power switch (not shown) is closed, the power supply switching element 102 is closed, and the drive power supply voltage Vb from the external power supply 101 is applied to the vehicle mounted engine control apparatus 100A, whereby the control power supply voltage Vcc stabilized through the constant voltage power supply circuit 120 is supplied to the microprocessor 110.

The microprocessor 110 controls the electric load group 104 and the upstream and downstream heaters 53*f*, 53*r* based on the detection signals from the input sensor group 106, the operating states of the upstream and downstream exhaust gas sensors 105*f*, 105*r*, and the input and output control program stored in the program memory 112A.

In addition, the microprocessor 110 makes abnormality determinations with respect to a variety of kinds of input sensors and output loads, drives the alarm indicator 103 at the time of occurrence of abnormality, and notifies the occurrence of abnormality to the driver of a vehicle concerned.

In the following, reference will be made to a control operation on the upstream and downstream heaters 53*f*, 53*r* according to the first embodiment of the present invention shown in FIG. 1, while referring to flow charts of FIG. 5 and FIG. 6.

Figure 5:
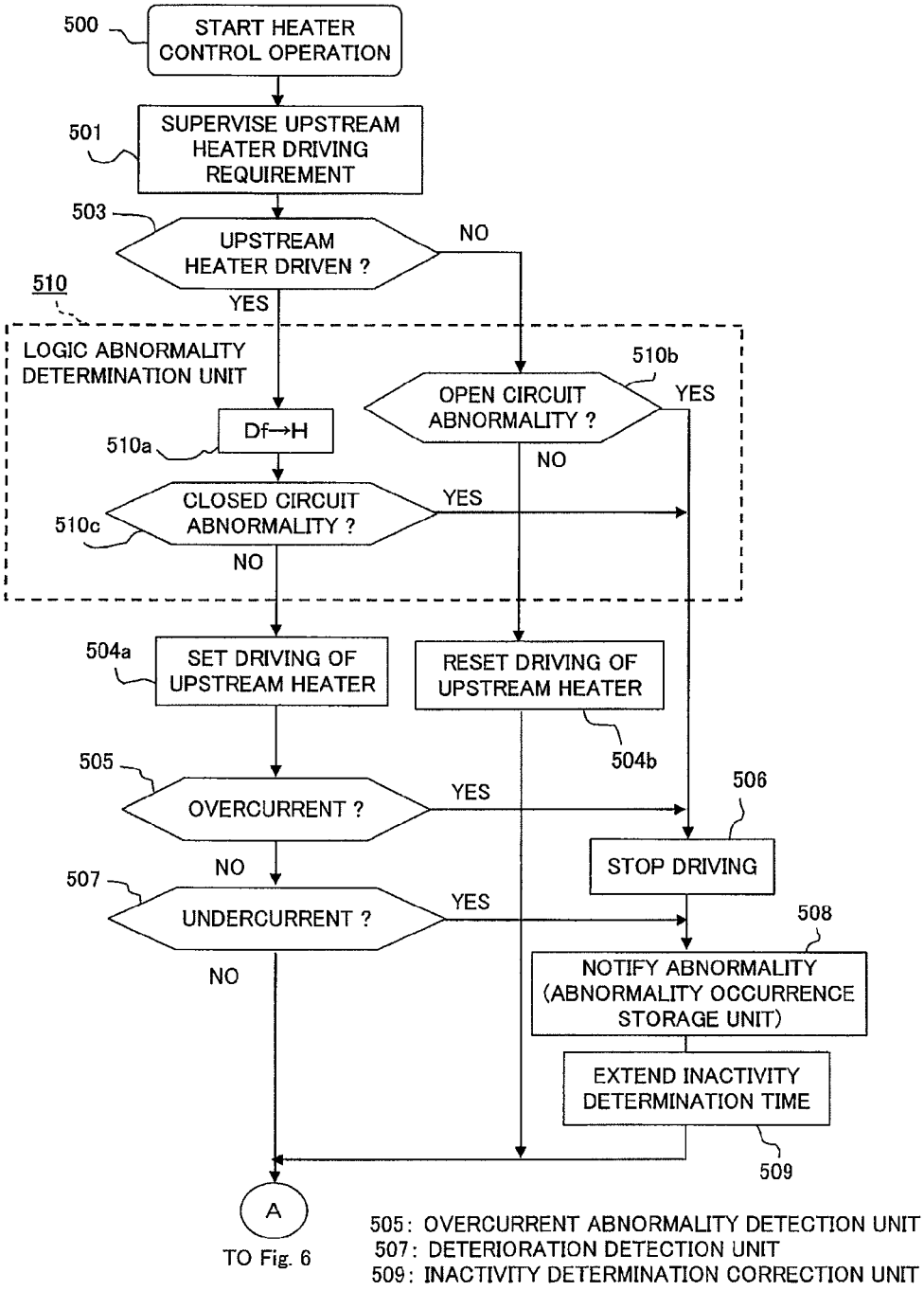
FIG. 5 is a flow chart for explaining a first half operation in heater control according to the first embodiment of the present invention.
Figure 6:
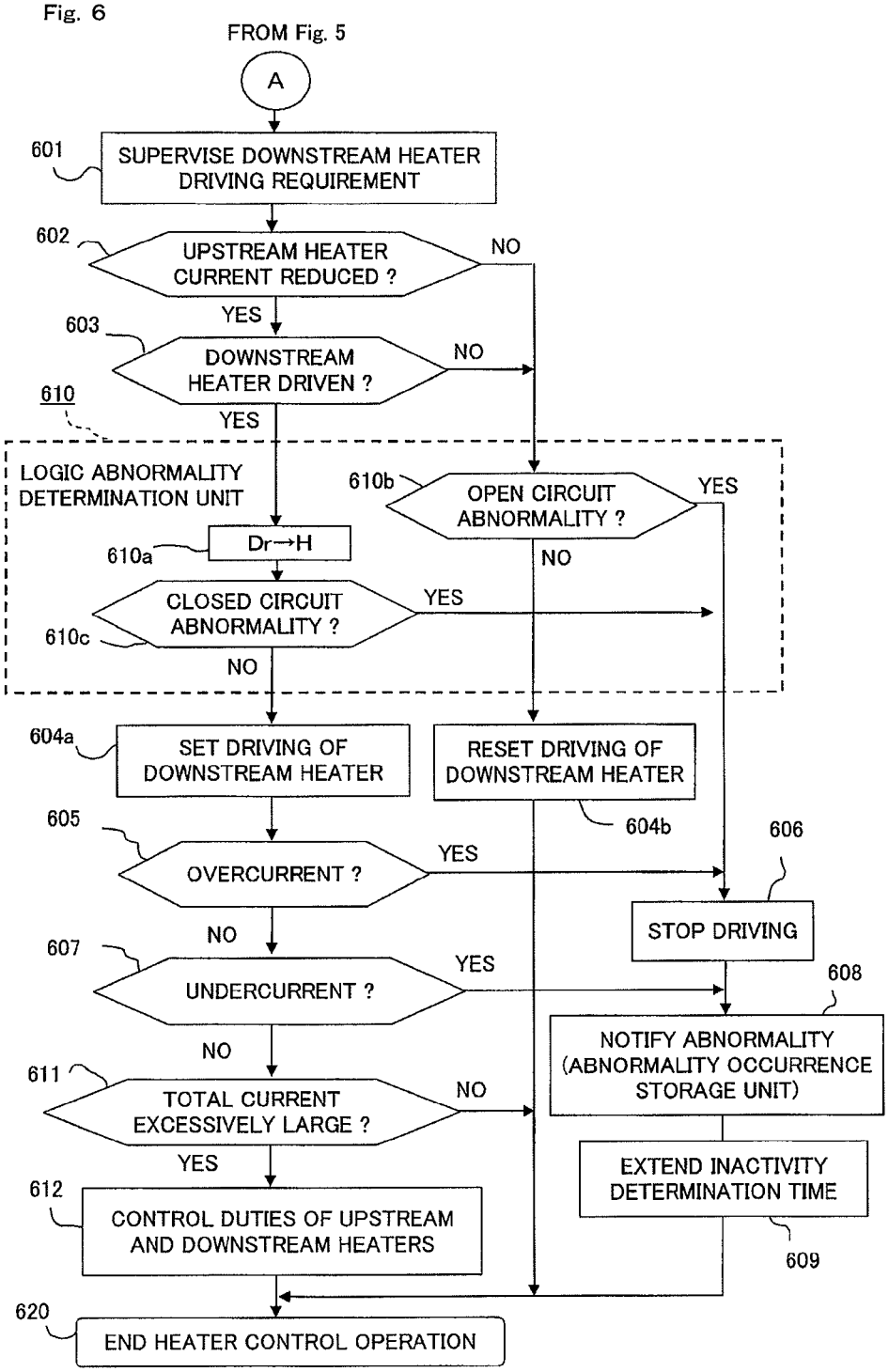
FIG. 6 is a flow chart for explaining a second half operation in heater control according to the first embodiment of the present invention.

FIG. 5 is a flow chart which shows the power supply control of the upstream heater 53*f* (first half operation), and FIG. 6 is a flow chart which shows the power supply control of the downstream heater control 53*r* (second half operation).

First of all, in FIG. 5, step 500 is an operation start step of heater control carried out by the microprocessor 110, and the following step 501 is a step to supervise whether a driving requirement related to the engine rotational speed N and engine temperature hold for the upstream heater 53*f*.

The following step 503 is a step to determine whether the upstream heater 53*f* is driven as a result of the supervision in step 501, and in cases where the upstream heater 53*f* is driven to be supplied with electric power, a positive determination (i.e., "YES") is made and the control flow shifts to step 510*a*, whereas in cases where the electric power supply driving requirement does not hold, a negative determination (i.e., "NO") is made and the control flow shifts to step 510*b*.

In step 510*a*, the logic level of the heater driving command Df is temporarily set to be high ("H" level), so that the upstream switching element 50*f* is driven to be closed.

The following step 510*c* is a step to determine the presence or absence of a closed circuit abnormality, and when there is a closed circuit abnormality, a positive determination ("YES") is made, and the control flow shifts to step 506, whereas when there is not a closed circuit abnormality, a negative determination ("NO") is made, and the control flow shifts to step 504*a*.

On the other hand, step 510*b*, which is executed in cases where a negative determination ("NO") is made in step 503, is a step to determine the presence or absence of an open circuit abnormality, and when there is an open circuit abnormality, a positive determination ("YES") is made, and the control flow shifts to step 506, whereas when there is not an open circuit abnormality, a negative determination ("NO") is made, and the control flow shifts to step 504*b*.

A step block 510 comprising the above-mentioned steps 510*a*, 510*b*, and 510*c* constitutes a logic abnormality determination unit.

Let us assume that the upstream heater 53*f*, the upstream switching element 50*f* and its wiring circuit in FIG. 1 are normal, and in this case, when the logic level of the heater driving command Df is low ("L"), the upstream switching element 50*f* is opened so that the supply of electric power to the upstream heater 53*f* is not carried out, and the input terminal voltage of the inverting logic element 56*f* is at a high voltage level "H" equal to the drive power supply voltage Vb. As a result, the logic level of the logic supervisory signal Tf outputted from the inverting logic element 56*f* becomes a low level ("L").

Similarly, let us assume that the upstream heater 53*f*, the upstream switching element 50*f* and its wiring circuit are normal, and when the logic level of the heater driving command Df becomes high ("H"), the upstream switching element 50*f* is closed so that the supply of electric power to the upstream heater 53*f* is carried out, and the input terminal voltage of the inverting logic element 56*f* becomes a low voltage level "H" corresponding to the closed circuit voltage of the upstream switching element 50*f*. As a result, the logic level of the logic supervisory signal Tf outputted from the inverting logic element 56*f* becomes a high level ("H").

On the other hand, in a state where the logic level of the heater driving command Df is low ("L") and the supply of electric power to the upstream heater 53*f* is stopped, if the upstream heater 53*f* or its wiring is disconnected, or if the upstream switching element 50*f* itself is in the state of a short circuit abnormality, or if the upstream heater 53*f* is in a ground fault state in which its negative terminal wiring is in mixed contact with a ground circuit, the input voltage level of the inverting logic element 56*f* becomes low ("L"). In this case, despite that the logic level of the heater driving command Df is low ("L"), the logic level of the logic supervisory signal Tf becomes high ("H"), so an open circuit abnormality is detected.

In addition, in a state where the logic level of the heater driving command Df is high ("H") and the supply of electric power to the upstream heater 53*f* is carried out, if the upstream heater 53*f* is internally short circuited, or if the upstream heater 53*f* is in a power supply short circuit state in which its negative terminal wiring is in mixed contact with a power line, an excessive current flows into the current sensing resistor 57*f*, so an overcurrent abnormality detection unit (i.e., step 505 to be described later) is operated to open the upstream switching element 50*f*.

Further, when the upstream switching element 50*f* itself is a disconnected open circuit abnormality despite that the logic level of the heater driving command Df is "H" and a power supply command to the upstream heater 53*f* is generated, the output logic level of the inverting logic element 56*f* becomes "L", so a closed circuit abnormality is detected.

Returning to FIG. 5, in step 504*a* following the negative determination ("NO") in step 510*c*, the heater driving command Df according to the step 510*a* is maintained at the logic level "H" (i.e, the driving of the upstream heater 53*f* is set), and the control flow shifts to step 505.

On the other hand, in step 504*b* following the negative determination ("NO") in step 510*b*, the heater driving command Df set in step 504*a* is reset (i.e., the driving of the upstream heater 53*f* is reset), and the control flow shifts to step 601 in FIG. 6 through a relay terminal A to FIG. 6.

In step 505, it is determined whether the value of the heater current detection signal Cf exceeds the above-mentioned overcurrent determination threshold Imax (see FIG. 3B) (i.e., whether the heater current is excessively large), and when it exceeds the overcurrent determination threshold Imax, a positive determination ("YES") is made, and the control flow shifts to step 506, whereas when it does not exceed the overcurrent determination threshold Imax, a negative determination ("NO") is made, and the control flow shifts to step 507.

In step 506, by setting the logic level of the heater driving command Df to an "L" level, the upstream switching element 50*f* is forced to be interrupted (i.e., the driving thereof is stopped), and the control flow shifts to step 508.

On the other hand, in step 507, it is determined whether the value of the heater current detection signal Cf is less than the above-mentioned deterioration determination threshold Imin (see FIG. 3B) (i.e., whether the heater current is excessively small), and when it is less than the deterioration determination threshold Imin, a positive determination ("YES") is made, and the control flow shifts to step 508, whereas when it is equal to or more than the deterioration determination threshold Imin, a negative determination ("NO") is made, and the control flow shifts to step 601 in FIG. 6 through the relay terminal A.

In step 508, an abnormality notification command is generated, so that the alarm indicator 103 is thereby driven (a notification of abnormality is made), and at the same time, abnormality occurrence information is stored into a predetermined address in the RAM memory 111 according to factors.

In the following step 509, an inactivity determination time in the inactive abnormality detection unit 704*b* (to be described later together with FIG. 7) is extended, after which the control flow shifts to step 601 in FIG. 6 through the relay terminal A.

Next, the control of the downstream heater 53*r* in FIG. 6 (second half operation) will be described.

In FIG. 6 (downstream heater control), steps 601, 603 through 610, and 610*a* through 610*c* are the same as steps 501, 503 through 510, and 510*a* through 510*c* in FIG. 5 (upstream heater control), so a detailed description thereof is omitted.

However, in FIG. 6, step 602 following step 601, and steps 611, 612 following step 607 are added, so the following explanation will be made focusing on these differences.

First, a driving requirement for the downstream heater 53*r* is supervised in step 601, and in the following step 602, it is determined whether a drive current for the upstream heater 53*f* has reduced to a predetermined value or less, and when it has reduced to the predetermined value or less, a positive determination ("YES") is made, and the control flow shifts to step 603, whereas when it has not reduced to the predetermined value or less, a negative determination ("NO") is made, and the control flow shifts to step 610*b*.

Hereinafter, the control flow advances to the same steps 603 through 610*c* as the above-mentioned ones, and determination processing in step 607 is performed.

In cases where the determination result in step 607 is "NO" (i.e., the current is within an upper and lower limit range) and the supply of electric power to the downstream heater 53*r* succeedingly continues, determination processing in step 611 is carried out.

In step 611, it is determined whether the total current of the upstream and downstream heaters 53*f*, 53*r* detected by the heater current detection signals Cf, Cr is equal to or larger than a total predetermined value (i.e., the total current is excessively large), and when the total current is excessively large, a positive determination ("YES") is made, and the control flow shifts to step 612, whereas when the total current is not excessively large, a negative determination ("NO") is made, and the control flow shifts to step 620 (i.e., operation end processing of the heater control in FIG. 5 and FIG. 6).

In step 612, by performing a reduced voltage supply while reducing the on time/the on-off cycle or period of the upstream and downstream switching elements 50*f*, 50*r* (i.e., the driving duty of the upstream and downstream heaters 53*f*, 53*r*), the upstream and downstream switching elements 50*f*, 50*r* are set to a PWM control mode for the suppression control of an overcurrent, and then, the control flow shifts to an operation end step 620.

In the operation end step 620 executed following the negative determination ("NO") in step 611 or following the steps 609, 604*b*, the microprocessor 110 executes other control programs, and shifts to step 500 (operation start processing) in FIG. 5 again within a predetermined time.

By doing so, the steps of the control flow from step 500 to step 620 are executed in a repeated manner.

Hereinafter, the entire control flow as shown in FIG. 5 and FIG. 6 will be described as a whole.

The overcurrent abnormality detection units corresponding to the steps 505, 605 generate abnormality detection signals, respectively, in response to when a supply current to the upstream and downstream heaters 53*f*, 53*r* detected by the current sensing resistors 57*f*, 57*r* has exceeded a predetermined upper limit value, and open the upstream and downstream switching elements 50*f*, 50*r* (i.e., stop the driving of the heaters) in steps 506, 606, respectively.

The deterioration detection units corresponding to the steps 507, 607 generate abnormality detection signals, respectively, in response to when a supply current to the upstream and downstream heaters 53*f*, 53*r* detected by the current sensing resistors 57*f*, 57*r* has become less than a predetermined lower limit value, and make a notification of abnormality in steps 508, 608, respectively.

Here, note that a determination lower limit current in the deterioration detection units 507, 607 is corrected in such a manner that it becomes larger in proportion to the drive power supply voltage Vb (power supply voltage) to the upstream and downstream heaters 53*f*, 53*r*.

The logic abnormality determination units corresponding to the step blocks 510, 610 supervise logical compatibility between the heater driving commands Df, Dr to the upstream and downstream switching elements 50*f*, 50*r*, and the logic supervisory signals Tf, Tr responding to the conductive states of the upstream and downstream switching elements 50*f*, 50*r*, and determine the presence or absence of the open circuit or short circuit abnormality of the upstream and downstream heaters 53*f*, 53*r*, or the presence or absence of the open circuit or short circuit abnormality of the upstream and downstream switching elements 50*f*, 50*r*.

Inactivity determination correction units corresponding to the steps 509, 609 extend inactive abnormality determination times in the inactive abnormality detection units 704*b*, 701*b* (to be described later together with FIG. 7), respectively, in response to when the overcurrent abnormality detection units 505, 606, or the deterioration detection units 507, 607, or the logic abnormality determination units 510, 610 have detected abnormality.

A delayed power supply time determination unit corresponding to the step 602 starts the supply of electric power to the downstream heater 53*r* in response to when the current supplied to the upstream heater 53*f* detected by the current sensing resistor 57*f* has become equal to or less than a predetermined set threshold.

Here, note that the set threshold in the delayed power supply time determination unit 602 is corrected in such a manner that it becomes larger in proportion to the drive power supply voltage Vb (power supply voltage) to the upstream heater 53*f*.

A heater voltage control unit 612 corresponding to the step 612 suppresses the average supply voltage to the upstream heater 53*f* and the downstream heater 53*r* by controlling the conducting duties of the upstream and downstream switching elements 50*f*, 50*r* so as to prevent the total current of the upstream heater 53*f* and the downstream heater 53*r* from exceeding the predetermined value, at the time when the supply of electric power to the downstream heater 53*r* is started with attenuation of the current supplied to the upstream heater 53*f*.

In the above explanation, the overcurrent abnormality detection units 505, 605 are achieved by the determination processing function of the microprocessor 110, but a comparison determination circuit and an overcurrent abnormality occurrence storage circuit may be formed in the exterior of the microprocessor 110, and the driving of the upstream and downstream switching elements 50*f*, 50*r* can be stopped by means of an output of the overcurrent abnormality occurrence storage circuit at the time of occurrence of an overcurrent.

Next, reference will be made to an air fuel ratio control operation according to the first embodiment of the present invention shown in FIG. 1, while referring to a flow chart of FIG. 7 together with a schematic control block diagram in FIG. 4.

In FIG. 7, step 700 is an operation start step in which the microprocessor 110 starts air fuel ratio control.

The following step 701*a* is an activation detection step to determine whether the downstream exhaust gas sensor 105*r* is in an activated state, and when it is in an activated state, a positive determination ("YES") is made, and the control flow shifts to step 702, whereas when it is not in an activated state, a negative determination ("NO") is made, and the control flow shifts to step 701*b*.

Here, note that in step 701*a* which serves as an activation detection unit, by detecting when the detection signal voltage AF2 of the downstream exhaust gas sensor 105*r* has changed, for example, from an L (low) level of 0.25 [V] or less to an H (high) level of 0.75 [V] or more, a determination is made that the downstream exhaust gas sensor 105*r* has been activated.

In step 701*b* which serves as the inactive abnormality detection unit, when a timing timer (not shown) is started and exceeds a predetermined time, a positive determination ("YES") is made, and the control flow shifts to step 701*c* (abnormality processing unit), whereas when the timer does not exceeds the predetermined time, a negative determination ("NO") is made, and the control flow shifts to step 702.

Here, note that the "NO" determination in step 701*b* means that the downstream exhaust gas sensor 105*r* is in an "unactivated state" in which it does not reach its activation temperature, and the "YES" determination in step 701*b* means that the downstream exhaust gas sensor 105*r* is in an "inactive abnormality state" in which it is still not activated even if a sufficient heating time has elapsed.

In addition, in cases where the downstream exhaust gas sensor 105*r* is once activated to perform a normal operation, when the detection signal voltage AF2 of the downstream exhaust gas sensor 105*r* does not change from the "L" level to the "H" level, or also when it does not change from the "H" level to the "L" level, it is determined in step 701*b* that the downstream exhaust gas sensor 105*r* is in an "inactive abnormality state".

In step 701*c* which constitutes the abnormality processing unit, an abnormality notification command is generated to drive the alarm indicator 103, and at the same time, abnormality occurrence information is stored into a predetermined address in the RAM memory 111 according to factors.

On the other hand, in step 702 which serves as the target air fuel ratio setting unit, the second target voltage AF02 is set, and in the following step 703*a*, second PID control acting as the downstream air fuel ratio control unit is started.

However, in step 703*a*, in cases where the downstream exhaust gas sensor 105*r* is in the unactivated state, the average value of the detection signal voltage AF2 is smaller as compared with the second target voltage AF02, so a PID control output is increased due to an increase in a deviation integrated value, but a second PID control output is limited so as not to rise to a value equal to or more than the second upper limit value.

The following step 703*d* constitutes the control abnormality detection unit of step 703*a* serving as the inactivity correction unit, and determines whether a time limit in step 703*a* is excessively large.

That is, in step 703*d*, in cases where the state of limitation of the second PID control output continues over a predetermined time or more, a positive determination ("YES") is made and the control flow shifts to the above-mentioned step 701*c*, where when a normal PID control operation is started within a predetermined time and the output limitation state is escaped, a negative determination ("NO") is made and the control flow shifts to step 704*a*.

In step 703*c* following the step 701*c*, an alternate setting value is applied in place of the second PID control output in step 703*a*, and the control flow shifts to step 704*a*.

That is, as the first target voltage AF01 for the upstream air fuel ratio control unit 705*a*, the second PID control output from the downstream air fuel ratio control unit 703*a* or the alternate setting value from the inactivity correction unit 703*c* is applied in accordance with the determination result of the inactive abnormality detection unit 701*b* or the control abnormality detection unit 703*d*, as shown in FIG. 4.

Here, note that the alternate setting value in place of the first PID control output is calculated by interpolation calculation from a value corresponding to the current engine rotational speed N and the current amount of intake air Qa based on the learning storage values stored in step 707 to be described later.

The following steps 704*a* through 704*c*, 705*a*, 705*c* and 705*d* are related to upstream air fuel ratio control, wherein the steps 704*a*, 704*b* and 704*c* correspond to the first half (downstream air fuel ratio control) steps 701*a*, 701*b* and 701*c*, respectively, and the steps 705*a*, 705*c* and 705*d* correspond to the above-mentioned steps 703*a*, 703*c* and 703*d*, respectively.

Accordingly, the step 704*a* corresponds to the activation detection unit; the step 704*b* corresponds to the inactive abnormality detection unit; the step 704*c* corresponds to the abnormality processing unit; the step 705*a* corresponds to the air fuel ratio control units; the step 705*c* corresponds to the inactivity correction unit; and the step 705*d* corresponds to the control abnormality detection unit.

The first PID control output from the upstream air fuel ratio control unit 705*a* or the alternate setting value from the inactivity correction unit 705*c* is applied as the air fuel ratio correction coefficient Kc for the fuel injection control unit 706.

In the step block 706 (corresponding to the fuel injection control unit) comprising the following steps 706*a* through 706*e*, first, in step 706*a*, a correction value Kc×AF00, which is obtained by multiplying the voluntary target air fuel ratio AF00 in the above-mentioned equation (4) by the air fuel ratio correction coefficient Kc, is applied in place of the voluntary target air fuel ratio AF00.

In the following step 706*b*, the amount of intake air Qa is calculated and in the following step 706*c*, an appropriate amount of fuel supply F is calculated.

In the following step 706*d*, the valve opening time ΔT of the injector 13 is calculated, and in the following step 706*e*, the fuel injection electromagnetic valve of the injector 13 is driven at timing in response to the crank angle sensor 14.

The following step 707 constitutes the learning storage unit, which reads out in a sampling manner the air fuel ratio correction coefficient Kc, which is the PID control output from each of the upstream and downstream air fuel ratio control units 705*a*, 703*a*, and the value of the first target voltage AF01, and stores, in the RAM memory 111, the engine rotational speed N of the internal combustion engine 10, the air fuel ratio correction coefficient Kc corresponding to the value of the amount of intake air per second q detected by the air flow sensor 12, and the average value of the first target voltage AF01.

In the following step 708, it is determined whether the power switch (not shown) has been changed from its close state to its open state (ON→OFF), and when the power switch has not been changed while maintaining its close state, a negative determination ("NO") is made, and the control flow shifts to an operation end step 710, whereas when the power switch has been changed into its open state, a positive determination ("YES") is made and the control flow shifts to step 709.

In step 709, abnormality occurrence storage information by means of the step 508 and the step 608 (the abnormality occurrence storage units) in FIG. 5 and FIG. 6, abnormality occurrence storage information by means of the steps 701*c*, 704*c* (the abnormality processing units) in FIG. 7, and learning storage information by means of the step 707 are transmitted to and stored in the nonvolatile data memory 113, and then the control flow shifts to the operation end step 710.

Here, note that in the execution process of step 709 (stored information preservation unit), the power switch is opened, but the power supply switching element 102 is still closed, and after save processing, which transmits the data requiring preservation among the data stored in the RAM memory 111 to the nonvolatile data memory 113, is completed, the power supply switching element 102 is opened, and the operation of the microprocessor 110 is stopped.

In addition, if the power switch is in its closed state, the microprocessor 110 executes other control programs in the operation end step 710, returns to the operation start step 700 again within a predetermined time, so that it executes the steps of the control flow between the operation start step 700 and the operation end step 710 in a repeated manner.

Although in the above explanation, the air flow sensor 12 is arranged for measuring the amount of intake air Qa in the internal combustion engine 10, it is also possible to arithmetically calculate the amount of intake air Qa by the use of the engine rotational speed N and a detection signal of the throttle position sensor, in place of the air flow sensor 12.

In addition, although a sensor having a nonlinear output characteristic (FIG. 2A) has been used as the upstream exhaust gas sensor 105*f*, it is also possible to use a sensor having a linear output characteristic (to be described later).

In this case, by using a sensor interface circuit (not shown) in place of the first digital filter circuit in the upstream air fuel ratio control unit 705*a*, it is possible to obtain a linear detection value corresponding to the air fuel ratio NF (i.e., the ratio Qa/F of the amount of intake air Qa to the amount of fuel supply F).

Here, note that a sensor of a linear output characteristic may also be used for the downstream exhaust gas sensor 105*r*, but in general, an inexpensive sensor of a nonlinear output characteristic is used for this purpose.

In addition, although the air fuel ratio correction coefficient Kc is generated in the upstream air fuel ratio control unit 705*a*, an air fuel ratio correction value ΔAF00 may be generated in place of the air fuel ratio correction coefficient Kc.

In this case, the voluntary target air fuel ratio AF00 applied in the fuel injection control unit 706 may be replaced with the sum of the voluntary target air fuel ratio AF00 and an air fuel ratio correction value ΔAF00.

As described above, connected to the vehicle mounted engine control apparatus 100A according to the first embodiment (FIG. 1 through FIG. 7) of the present invention are the crank angle sensor 14 (rotation sensor) that generates a pulse signal corresponding to the rotational speed N of the internal combustion engine 10, the air flow sensor 12 or negative pressure sensor arranged in the intake passage of the internal combustion engine 10, the upstream and downstream exhaust gas sensors 105*f*, 105*r* that are arranged in an upstream position and a downstream position, respectively, of the catalyzer 15 arranged in the exhaust passage of the internal combustion engine 10, and generate the nonlinear or linear detection signal voltages AF1, AF2 corresponding to the air fuel ratio NF which is the ratio (Qa/F) of the amount of intake air Qa to the amount of fuel supply F, and the upstream and downstream heaters 53*f*, 53*r* to which electric power is supplied so as to activate the upstream and downstream exhaust gas sensors 105*f*, 105*r* at an early stage, at the time when a predetermined requirement is satisfied.

The vehicle mounted engine control apparatus 100A is provided with the microprocessor 110 that cooperates with the program memory 112A to execute or achieve the fuel injection control unit 706 and the upstream and downstream air fuel ratio control units 705*a*, 703*a*, and at the same time, is also provided with the heater control circuit 150 that includes the upstream and downstream switching elements 50*f*, 50*r* which are driven and controlled by the microprocessor 110 so as to supply electric power to the upstream and downstream heaters 53*f*, 53*r*, and the current sensing resistors 57*f*, 57*r* for supplying the heater current detection signals Cf, Cr to the microprocessor 110.

The fuel injection control unit 706 adjusts the valve opening time ΔT of the injector 13, which is the electromagnetic coil for driving the fuel injection electromagnetic valve, thereby to control the amount of fuel injection, in proportion to the amount of intake air Qa, which is detected by the air flow sensor 12, or arithmetically calculated from the rotational speed N of the internal combustion engine 10 and the detection value of the negative pressure sensor which is arranged in the intake pipe 11, and controls the amount of fuel supply F in such a manner that the predetermined voluntary target air fuel ratio AF00 can be obtained.

The upstream air fuel ratio control unit 705*a* generates to the fuel injection control unit 706 a correction command to increase or decrease the amount of fuel supply F in such a manner that the air fuel ratio in an upstream position corresponding to the detection signal voltage AF1 obtained from the upstream exhaust gas sensor 105*f* matches the first target voltage AF01 which is a target air fuel ratio in the upstream position.

The downstream air fuel ratio control unit 703*a* corrects the first target voltage AF01 in such a manner that the air fuel ratio in a downstream position corresponding to the detection signal voltage AF2 obtained from the downstream exhaust gas sensor 105*r* matches the second target voltage AF02 which is a target air fuel ratio in the downstream position.

At the time when the supply current to the upstream heater 53*f* declines to the predetermined value or less in accordance with the temperature rise of the upstream heater 53*f* to which electric power has first been supplied, the supply of electric power to the downstream heater 53*r* is started even if the upstream exhaust gas sensor 105*f* is still in its unactivated state.

The value of the voluntary target air fuel ratio AF00 of the fuel injection control unit 706 is set to the first initial value in which the exhaust gas becomes a fuel rich state, until the resistance value Rs of the internal resistance 52*f* of the upstream exhaust gas sensor 105*f* decreases to generate the upstream side detection signal voltage AF1.

In addition, the first target voltage AF01 to the upstream air fuel ratio control unit 705*a* is set to the second initial value in which the exhaust gas becomes a fuel rich state, until the resistance value Rs of the internal resistance 52*r* of the downstream exhaust gas sensor 105*r* decreases to generate the downstream side detection signal voltage AF2.

The upstream air fuel ratio control unit 705*a* is composed of the first digital filter circuit that is related to the deviation voltage between the first target voltage AF01 and the nonlinear detection signal voltage AF1, and the first PID regulation circuit that performs negative feedback control, or is composed of the sensor interface circuit that obtains a linear signal voltage proportional to the air fuel ratio, and a third PID regulation circuit to which a deviation voltage between the linear signal voltage and the first target voltage AF01 is inputted.

The output voltage of the first or third PID regulation circuit is restricted so as not to be a rich command output in which the output voltage is equal to or larger than the first upper limit value, and the first initial value for the fuel injection control unit 706 at the time when the upstream exhaust gas sensor 105*f* is in its unactivated state is decided by the first upper limit value.

The downstream air fuel ratio control unit 703*a* is composed of the second digital filter circuit that is related to the deviation voltage between the second target voltage AF02 and the nonlinear detection signal voltage AF2, and the second PID regulation circuit, wherein the output voltage of the second PID regulation circuit is restricted so as not to be a rich command output in which the output voltage is equal to or larger than the second upper limit value.

The second upper limit value is the second initial value for the upstream air fuel ratio control unit 705*a* at the time when the downstream exhaust gas sensor 105*r* is in its unactivated state.

As described above, according to the first embodiment (claim 2) of the present invention, control commands from the upstream and downstream air fuel ratio control units 705*a*, 703*a* at the time when the upstream and downstream exhaust gas sensors 105*f*, 105*r* are in their unactivated states do not generate rich commands in which the output voltages of the first or third PID regulation circuit and the second PID regulation circuit are equal to or larger than the first and second upper limit values, respectively, and the first and second upper limit values are used as the first and second initial values for the fuel injection control unit 706 or the upstream air fuel ratio control unit 705*a*. As a result, it is possible to avoid the internal combustion engine 10 from becoming an excessively fuel rich operation state when the upstream and downstream exhaust gas sensors 105*f*, 105*r* are in their unactivated states.

In addition, because the deviation integration signal voltages of the PID regulation circuits are restricted, the upstream and downstream air fuel ratio control units 705*a*, 703*a* can shift to an air fuel ratio control operation in a smooth manner when the upstream and downstream exhaust gas sensors 105*f*, 105*r* are activated, respectively.

Moreover, the program memory 112A in the vehicle mounted engine control apparatus 100A according to the first embodiment of the present invention is provided with a control program that serves as the downstream and upstream activation detection units 701*a*, 704*a* for the downstream and upstream exhaust gas sensors 105*r*, 105*f*, and a control program that serves as the downstream and upstream inactive abnormality detection units 701*b*, 704*b* for the downstream and upstream exhaust gas sensors 105*r*, 105*f*, and a control program that serves as the downstream and upstream inactivity correction units 703*c*, 705*c* for the downstream and upstream exhaust gas sensors 105*r*, 105*f*.

The downstream activation detection unit 701*a* determines that the downstream exhaust gas sensor 105*r* has been activated, by detecting when the detection signal voltage AF2 of the downstream exhaust gas sensor 105*r* has changed from a lean (low) level to a rich (high) level, or from a rich (high) level to a lean (low) level.

The downstream inactive abnormality detection unit 701*b* determines that the downstream exhaust gas sensor 105*r* is in an inactive abnormality, by detecting that the detection signal voltage AF2 of the downstream exhaust gas sensor 105*r* has not changed from a lean (low) level to a rich (high) level, or from a rich (high) level to a lean (low) level even if a predetermined determination time has elapsed after electric power is supplied to the downstream heater 53*r*.

In response to the inactive abnormality detection unit 701*b* having detected the inactive abnormality state of the downstream exhaust gas sensor 105*r*, the downstream inactivity correction unit 703*c* inputs a predetermined alternative signal voltage, in place of the first target voltage AF01 generated by the downstream air fuel ratio control unit 703*a*, to the upstream air fuel ratio control unit 705*a*.

The upstream activation detection unit 704*a* determines that the upstream exhaust gas sensor 105*f* has been activated, by detecting when the detection signal voltage AF1 of the upstream exhaust gas sensor 105*f* has changed from a lean (low) level to a rich (high) level, or from a rich (high) level to a lean (low) level.

The upstream inactive abnormality detection unit 704*b* determines that the upstream exhaust gas sensor 105*f* is in an inactive abnormality, by detecting that the detection signal voltage AF1 of the upstream exhaust gas sensor 105*f* has not changed from a lean (low) level to a rich (high) level, or from a rich (high) level to a lean (low) level even if a predetermined determination time has elapsed after electric power is supplied to the upstream heater 53*f*.

In response to the inactive abnormality detection unit 704*b* having detected the inactive abnormality state of the upstream exhaust gas sensor 105*f*, the upstream inactivity correction unit 705*c* inputs a predetermined alternative signal voltage, in place of a correction command to increase or decrease the amount of fuel supply F generated by the upstream air fuel ratio control unit 705*a*, to the fuel injection control unit 706.

As described above, according to the first embodiment (claim 4) of the present invention, the program memory 112A is provided with control programs that serve as the activation detection units 701*a*, 704*a*, the inactive abnormality detection units 701*b*, 704*b*, and the inactivity correction units 703*c*, 705*c*, for the downstream and upstream exhaust gas sensors 105*r*, 105*f*.

Accordingly, in cases where the downstream and upstream exhaust gas sensors 105*r*, 105*f* are in the inactive states, it is possible to perform the control of the air fuel ratio in the exhaust gas without biasing it toward a fuel rich side by replacing an initial setting value at the time when the activation detection units 701*a*, 704*a* detect the unactivated states of the downstream and upstream exhaust gas sensors 105*r*, 105*f*, with an alternate setting value different from the initial setting value.

In addition, the program memory 112A in the vehicle mounted engine control apparatus 100A according to the first embodiment of the present invention is provided with a control program that serves as the downstream and upstream control abnormality detection units 703*d*, 705*d* for the downstream and upstream air fuel ratio control units 703*a*, 705*a* which operate at the time when the engine is not in the fuel cut operating state.

The downstream control abnormality detection unit 703*d* makes a determination that the downstream air fuel ratio control unit 703*a* is abnormal, in cases where the state in which the output generated by the downstream air fuel ratio control unit 703*a* is out of a predetermined upper and lower limit range continues over a predetermined time or more, and where the inactive abnormality detection unit 701*b* for the downstream exhaust gas sensor 105*r* does not detect any abnormality.

The upstream control abnormality detection unit 705*d* makes a determination that the upstream air fuel ratio control unit 705*a* is abnormal, in cases where the state in which the output generated by the upstream air fuel ratio control unit 705*a* is out of a predetermined upper and lower limit range continues over a predetermined time or more, and where the inactive abnormality detection unit 704*b* for the upstream exhaust gas sensor 105*f* does not detect any abnormality.

In response to the downstream control abnormality detection unit 703*d* having detected the abnormal state of the downstream air fuel ratio control unit 703*a*, the downstream inactivity correction unit 703*c* inputs a predetermined alternative signal voltage, in place of the first target voltage AF01 generated by the downstream air fuel ratio control unit 703*a*, to the upstream air fuel ratio control unit 705*a*.

In response to the upstream control abnormality detection unit 705*d* having detected the abnormal state of the upstream air fuel ratio control unit 705*a*, the upstream inactivity correction unit 705*c* inputs a predetermined alternative signal voltage, in place of the correction command to increase or decrease the amount of fuel supply F generated by the upstream air fuel ratio control unit 705*a*, to the fuel injection control unit 706.

As described above, according to the first embodiment (claim 5) of the present invention, the program memory 112A is provided with a control program that serves as the control abnormality detection units 703*d*, 705*d* for the downstream and upstream air fuel ratio control units 703*a*, 705*a*.

Accordingly, in cases where the downstream and upstream air fuel ratio control units 703*a*, 705*a* are in the abnormal states, it is possible to perform the control of the air fuel ratio in the exhaust gas without biasing it toward a fuel rich side by replacing an initial setting value at the time when the downstream and upstream activation detection units 701*a*, 704*a* detect the unactivated states of the downstream and upstream exhaust gas sensors 105*r*, 105*f*, with an alternate setting value different from the initial setting value.

Moreover, the program memory 112A according to the first embodiment of the present invention is provided with a control program which serves as the learning storage unit 707, and the learning storage unit 707 stores an average value of a plurality of latest output values of the downstream air fuel ratio control unit 703*a* or the upstream air fuel ratio control unit 705*a*, which have been stored in a sequential manner, corresponding to at least one of the amount of intake air Qa and the rotational speed N of the internal combustion engine 10.

An average value of measured data, which have been learned and stored by the learning storage unit 707 during the time when the downstream and upstream exhaust gas sensors 105*r*, 105*f* and the downstream and upstream air fuel ratio control units 703*a*, 705*a* are operating in a normal manner, is applied as the alternative signal voltage which is applied in the downstream or upstream inactivity correction unit 703*c*, 705*c*.

As described above, according to the first embodiment (claim 6) of the present invention, it is constructed such that in cases where the downstream and upstream exhaust gas sensors 105*r*, 105*f* are in inactive abnormality, an alternate setting value based on the learning storage values stored at the time when the downstream and upstream exhaust gas sensors 105*r*, 105*f* were normal are used as the target air fuel ratio.

Accordingly, in cases where the downstream and upstream exhaust gas sensors 105*r*, 105*f* are in the inactive states, it is possible to perform appropriate control of the air fuel ratio in the exhaust gas by replacing the initial setting value at the time when the downstream and upstream activation detection units 701*a*, 704*a* detect the unactivated states of the downstream and upstream exhaust gas sensors 105*r*, 105*f*, with an alternate setting value based on the learning storage values.

In addition, the program memory 112A according to the first embodiment of the present invention is provided with control programs that serve as the inactivity determination correction units 509, 609, and at least one pair of the overcurrent abnormality detection units 505, 605, the deterioration detection units 507, 607, and the logic abnormality determination units 510, 610, for the upstream and downstream heaters 53*f*, 53*r*.

The overcurrent abnormality detection units 505, 605 generate abnormality detection signals, respectively, in response to when a supply current to the upstream and downstream heaters 53*f*, 53*r* detected by the current sensing resistors 57*f*, 57*r* has exceeded a predetermined upper limit value, and open the upstream and downstream switching elements 50*f*, 50*r*, respectively.

The deterioration detection units 507, 607 generate abnormality detection signals, respectively, in response to when a supply current to the upstream and downstream heaters 53*f*, 53*r* detected by the current sensing resistors 57*f*, 57*r* has become less than a predetermined lower limit value.

The logic abnormality determination units 510, 610 supervise logical compatibility between the heater driving commands Df, Dr to the upstream and downstream switching elements 50*f*, 50*r*, and the logic supervisory signals Tf, Tr responding to the conductive states of the upstream and downstream switching elements 50*f*, 50*r*, and determine the presence or absence of the open circuit or short circuit abnormality of the upstream and downstream heaters 53*f*, 53*r*, or the presence or absence of the open circuit or short circuit abnormality of the upstream and downstream switching elements 50*f*, 50*r*.

The inactivity determination correction units 509, 609 extend inactive abnormality determination times in the inactive abnormality detection units 704*b*, 701*b*, respectively, in response to when the overcurrent abnormality detection units 505, 606, or the deterioration detection units 507, 607, or the logic abnormality determination units 510, 610 have detected abnormality.

As described above, according to the first embodiment (claim 7) of the present invention, when the abnormality of the upstream and downstream heaters 53*f*, 53*r* or the upstream and downstream switching elements 50*f*, 50*r* are detected by the overcurrent abnormality detection units 505, 606, the deterioration detection units 507, 607, or the logic abnormality determination units 510, 610, the inactive abnormality determination times in the inactive abnormality detection units 704*b*, 701*b* are extended by the inactivity determination correction units 509, 609, respectively, so even if the upstream and downstream heaters 53*f*, 53*r* are stopped due to the occurrence of abnormality, it is possible to carry out normal air fuel ratio control when the upstream and downstream exhaust gas sensors 105*f*, 105*r* are heated and activated by exhaust heat.

Moreover, according to the first embodiment (claim 8) of the present invention, a determination lower limit current in the deterioration detection units 507, 607 is corrected in such a manner that it becomes larger in proportion to the supply voltage (drive power supply voltage Vb) to the upstream and downstream heaters 53*f*, 53*r*. As a result, regardless of the change of the power supply voltage, it is possible to make an accurate determination as to whether the heater resistance Rh in a high temperature state increases abnormally, whereby the deterioration states of the upstream and downstream heaters 53*f*, 53*r* can be detected in an accurate manner.

Further, the program memory 112A according to the first embodiment of the present invention is provided with a control program that serves as the delayed power supply time determination unit 602, and the delayed power supply time determination unit 602 starts the supply of electric power to the downstream heater 53*r* in response to when the current supplied to the upstream heater 53*f* detected by the current sensing resistor 57*f* has become equal to or less than a predetermined set threshold.

Here, note that the set threshold in the delayed power supply time determination unit 602 is corrected in such a manner that it becomes larger in proportion to the supply voltage (drive power supply voltage Vb) to the upstream heater 53*f*.

As described above, according to the first embodiment (claim 9) of the present invention, the set threshold of the delayed power supply time determination unit 602, which serves to start the supply of electric power to the downstream heater 53*r* at a time later than the supply of electric power to the upstream heater 53*f*, is corrected to become larger in proportion to the supply voltage to the upstream heater 53*f*. As a result, when the power supply voltage is large, it is possible to prevent the supply of electric power to the downstream heater 53*r* from being started too late.

Furthermore, the program memory 112A according to the first embodiment of the present invention is provided with a control program that serves as the heater voltage control unit 612, and the heater control circuit 150 is formed as a power module that includes at least the upstream and downstream switching elements 50*f*, 50*r*.

The heater voltage control unit 612 suppresses the average supply voltage to at least the downstream heater 53*r* by controlling the conducting duties of the upstream and downstream switching elements 50*f*, 50*r* so as to prevent the total current of the upstream and downstream heaters 53*f*, 53*r* from exceeding a predetermined value, at the time when the supply of electric power to the downstream heater 53*r* is started with attenuation of the current supplied to the upstream heater 53*f*.

As described above, according to the first embodiment (claim 10) of the present invention, the supply voltage to at least the downstream heater 53*r* is suppressed so that the total current of the upstream and downstream heaters 53*f*, 53*r* does not exceed the predetermined value, as a result of which the delayed start time of the supply of electric power to the downstream heater 53*r* can be shortened to quicken the activation of the downstream exhaust gas sensor 105*r*, and at the same time, it is possible to prevent abnormal overheating of the upstream and downstream switching elements 50*f*, 50*r* in cases where the drive power supply voltage Vb is high.

Second Embodiment

Figure 8:
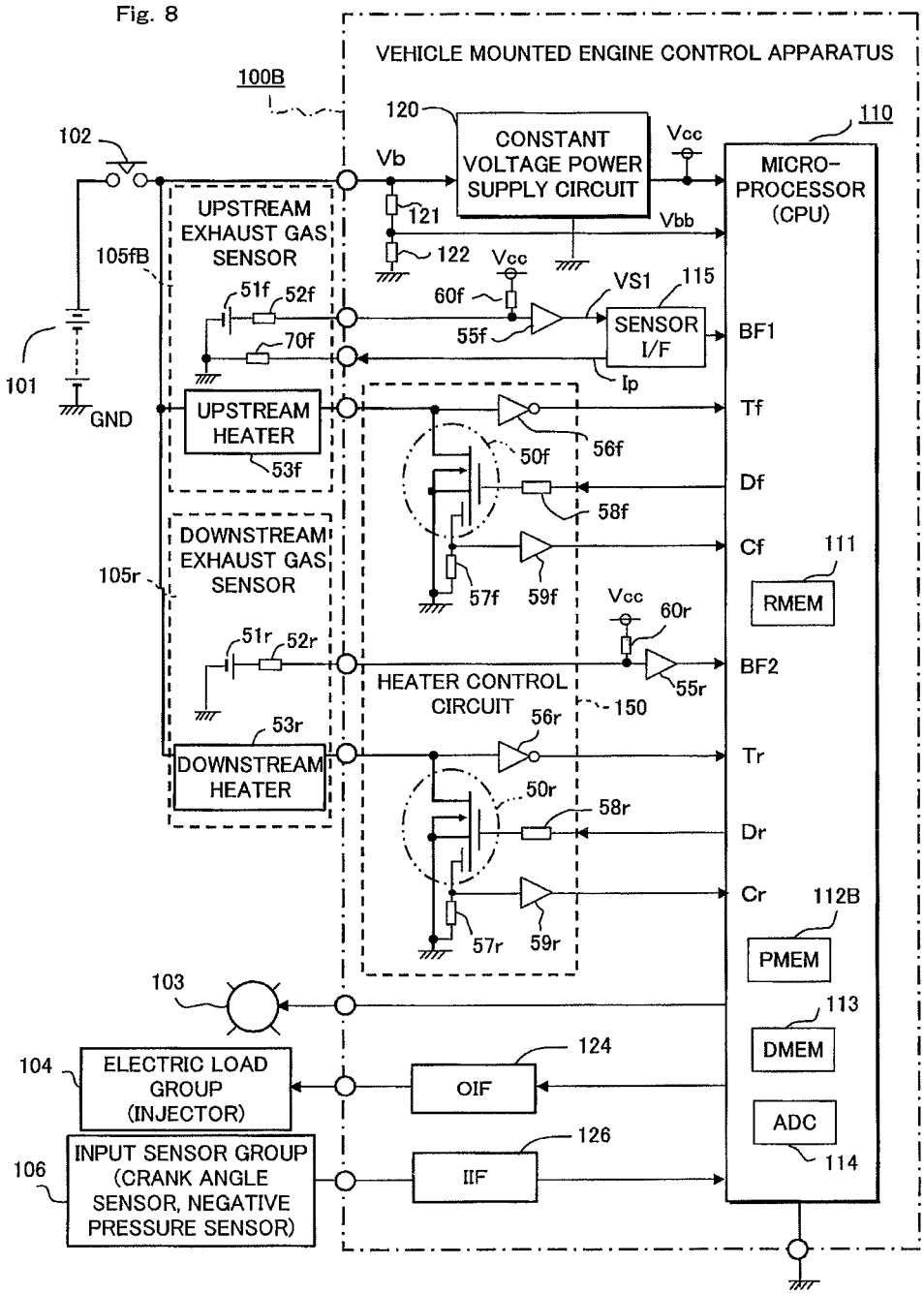
FIG. 8 is a circuit block diagram showing the overall construction of a vehicle mounted engine control apparatus according to a second embodiment of the present invention.

Although in the above-mentioned first embodiment (FIG. 1), an exhaust gas sensor having a nonlinear output characteristic (FIG. 2A) is used as the upstream exhaust gas sensor 105*f*, an exhaust gas sensor of the linear type, which cooperates with a sensor interface circuit 115, may be used as an upstream exhaust gas sensor 105*f*B, as shown in FIG. 8.

Hereinafter, a second embodiment of the present invention shown in FIG. 8 and FIG. 9 will be described by focusing on the points of difference from the above-mentioned first embodiment (FIG. 1 and FIG. 4).

Figure 9:
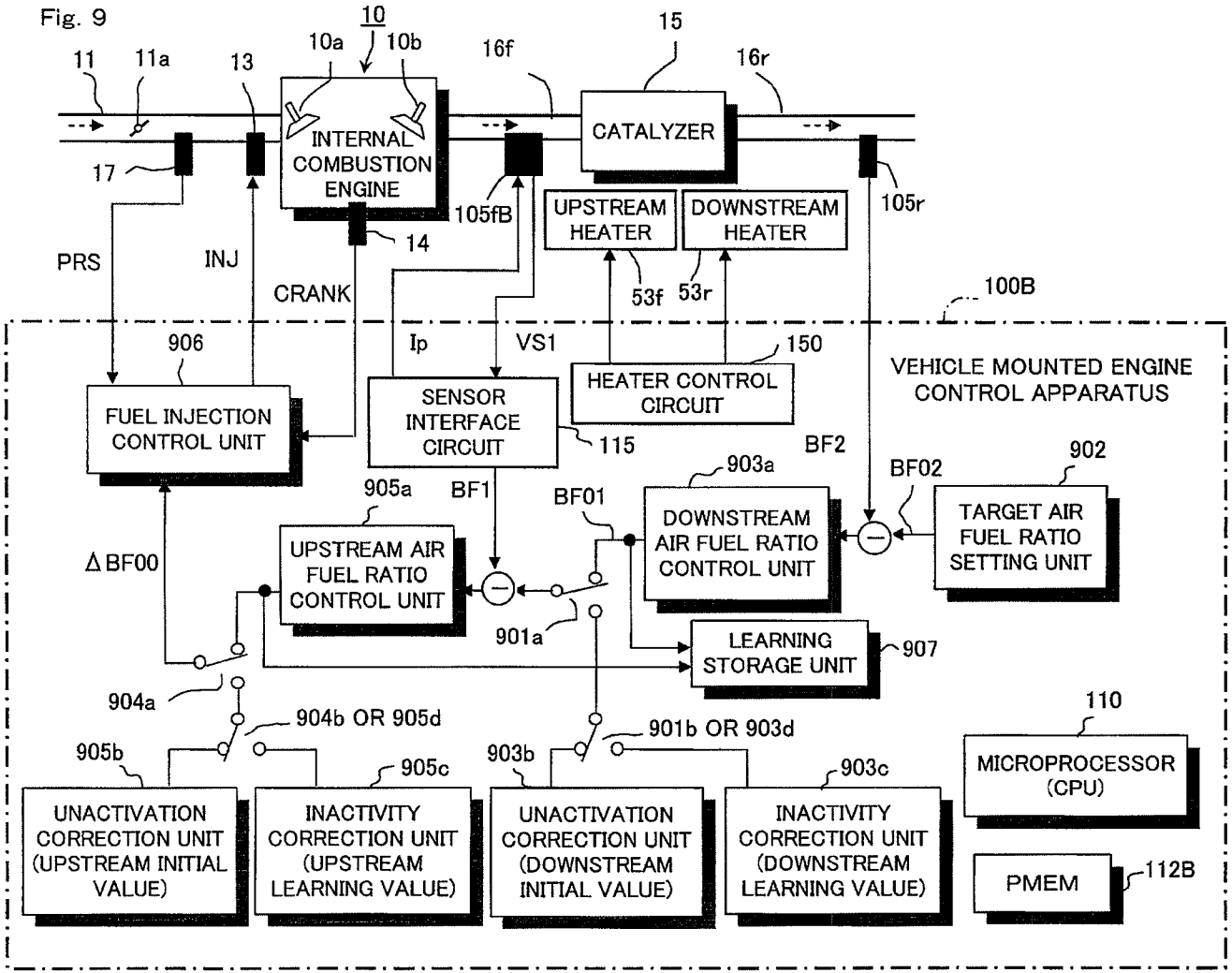
FIG. 9 is a functional block diagram showing the essential parts of the vehicle mounted engine control apparatus according to the second embodiment of the present invention, together with an engine construction.

FIG. 8 is a circuit block diagram which shows the overall construction of a vehicle mounted engine control apparatus 100B according to the second embodiment of the present invention, and FIG. 9 is a functional block diagram which shows essential parts in FIG. 8 together with an engine construction.

In FIG. 8 and FIG. 9, parts similar to those in the above-mentioned first embodiment (see FIG. 1 and FIG. 4) are denoted by the same symbols as those in the above-mentioned first embodiment, and "B" is attached to those parts which correspond to the above-mentioned ones at a location after each symbol.

In this case, too, the characteristics of upstream and downstream heaters 53*f*, 53*r* are as shown in FIGS. 3A and 3B.

In FIG. 8, connected to the vehicle mounted engine control apparatus 100B to which electric power is supplied from an external power supply 101 through a power supply switching element 102 are a pair of upstream and downstream exhaust gas sensors 105*f*B, 105*r*, and an input sensor group 106 of various kinds of sensors including at least a negative pressure sensor 17 arranged in an intake pipe, and a crank angle sensor 14.

The vehicle mounted engine control apparatus 100B performs power supply control on the electric load group 104 including the injector 13 and the upstream and downstream heaters 53*f*, 53*r* in response to the operating states of the group 106 of various kinds of input sensors, and at the same time operates an alarm indicator 103 upon occurrence of an abnormality.

A microprocessor 110, which constitutes a main part of the vehicle mounted engine control system 100B, cooperates with a RAM memory 111 for arithmetic processing, a program memory (for example, a nonvolatile flash memory) 112B, a data memory 113 (for example, a nonvolatile EEPROM memory), and a multi-channel AD converter 114.

The detection signals of analog sensors included in the input sensor group 106 are inputted to the microprocessor 110 through the multi-channel AD converter 114.

The program memory 112B stores therein an input and output control program for the input sensor group 106 and the electric load group 104, and also stores, in addition thereto, control programs for the upstream and downstream exhaust gas sensors 105*f*B, 105*r* and the upstream and downstream heaters 53*f*, 53*r*.

The details of the various control programs in the program memory 112B are shown in above-mentioned FIG. 5, FIG. 6, and FIG. 12 (to be described later).

The nonvolatile data memory 113 stores therein learning storage information and abnormality occurrence history information on the input sensor group 106 and the electric load group 104, and also stores, in addition thereto, learning storage information and abnormality occurrence history information on the upstream and downstream exhaust gas sensors 105*f*B, 105*r* and the upstream and downstream heaters 53*f*, 53*r*.

In this case, a detection signal voltage BF1 from the upstream exhaust gas sensor 105*f*B is inputted to the microprocessor 110 through not only an amplifier 55*f* but also the sensor interface circuit 115.

The sensor interface circuit 115 supplies a pump current Ip to an oxygen pump element 70*f* in the upstream exhaust gas sensor 105*f*B, and at the same time, generates a linear detection signal voltage BF1 proportional to the air fuel ratio from a nonlinear detection signal voltage VS1, and inputs it to the microprocessor 110.

A constant voltage power supply circuit 120, voltage dividing resistors 121, 122, an output interface circuit 124, an input interface circuit 126, and a heater control circuit 150 in the vehicle mounted engine control apparatus 100B are the same as those of the above-mentioned first embodiment (FIG. 1).

Raising resistors 60*f*, 60*r* are connected to the input terminal sides of the amplifiers 55*f*, 55*r*, respectively. The amplifier 55*f* has its output terminal connected to the microprocessor 110 through the sensor interface circuit 115, and the amplifier 55*r* has its output terminal directly inputted to the microprocessor 110.

The upstream exhaust gas sensor 105*f*B including the oxygen pump element 70*f* is connected to the microprocessor 110 through the sensor interface circuit 115.

The functional block diagram of FIG. 9 is shown in association with individual steps (processing functions) in FIG. 12 to be described later.

In FIG. 9, a pair of inactive abnormality detection units 901*b*, 904*b*, a target air fuel ratio setting unit 902, a pair of upstream and downstream air fuel ratio control units 905*a*, 903*a*, a pair of control abnormality detection units 903*d*, 905*d*, a pair of inactivity correction units 905*c*, 903*c*, a fuel injection control unit 906, and a learning storage unit 907 are the same as those in the above-mentioned first embodiment (FIG. 4), respectively, with each symbol "70X" being only replaced by "90X".

In addition, the detection signal voltages BF1, BF2 and a first and a second target voltage BF01, BF02 in FIG. 9 are the same as the detection signal voltages AF1, AF2 and the first and second target voltages AF01, AF02, respectively, in the above-mentioned first embodiment (FIG. 4).

The vehicle mounted engine control apparatus 100B is provided, in addition to the same construction as that of the above-mentioned first embodiment (FIG. 1), i.e., the microprocessor 110, the PMEM 112B, and the heater control circuit 150, with the sensor interface circuit 115, a pair of activation detection units 901*a*, 904*a*, and a pair of unactivation correction units 905*b*, 903*b*.

A detection signal from the negative pressure sensor 17 arranged in the intake pipe 11 and an air fuel ratio correction value ΔBF00 through the activation detection unit 904*a* are inputted to the fuel injection control unit 906.

Figure 10A:
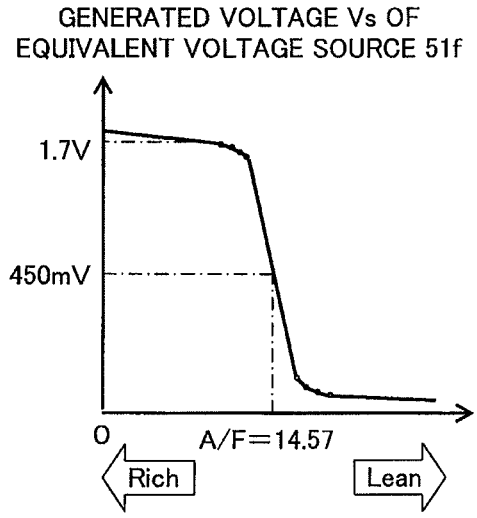
FIGS. 10A through 10C are explanatory views showing the characteristic curves of a linear type exhaust gas sensor used in the second embodiment of the present invention.
Figure 10B:
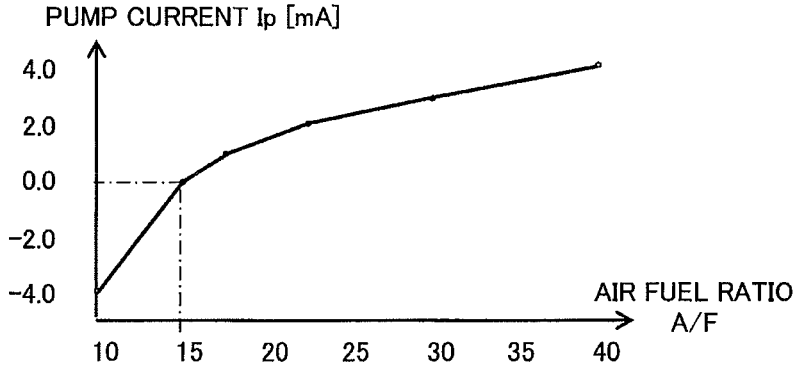
Figure 10C:
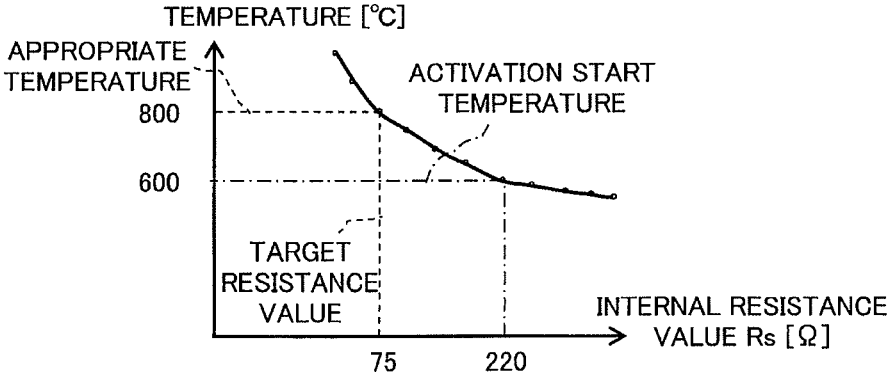

FIGS. 10A through 10C are explanatory views which show the characteristic curves of the upstream exhaust gas sensor 105*f*B of the linear type in FIG. 8, wherein FIG. 10A shows the output characteristic of an equivalent voltage source 51*f*, FIG. 10B shows the characteristic of the pump current Ip for the air fuel ratio NF, and FIG. 10C shows the temperature characteristic of the resistance value Rs of an internal resistance 52*f*.

FIG. 10A shows the output characteristic of an air fuel ratio detection signal, wherein the axis of abscissa represents the air fuel ratio A/F of an upstream exhaust gas, and the axis of ordinate represents the generated voltage Vs of the equivalent voltage source 51*f* in the upstream exhaust gas sensor 105*f*B, which is the same as in the case (FIG. 2A) of the upstream and downstream exhaust gas sensors 105*f*, 105*r* of the above-mentioned first embodiment (FIG. 1 and FIG. 4).

In FIG. 10A, with an amount of air of 14.57 [gr] (i.e., stoichiometric air fuel ratio A/F=14.57) required for complete combustion of gasoline of 1 [gr] being as a threshold, if fuel is richer than the threshold, the generated voltage Vs of the equivalent voltage source 51*f* will be saturated to a value of about 1.7 [V], and if fuel is leaner than the threshold, the generated voltage Vs will be saturated to a value of about 0 [V], and at the stoichiometric air fuel ratio, the generated voltage Vs becomes a reference voltage of 450 [mV].

Here, note that the equivalent voltage source 51*f* of the upstream exhaust gas sensor 105*f*B in FIG. 8 and FIG. 9 is arranged in a gas detection chamber for the upstream exhaust gas extracted by sampling, and the oxygen concentration in the gas detection chamber is fluctuated (increased or decreased) by the magnitude and the positive/negative sign of the pump current Ip which is supplied to the oxygen pump element 70*f*.

The relation between the air fuel ratio A/F and the pump current Ip is as shown in FIG. 10B.

The sensor interface circuit 115 operates to supply the pump current Ip to the oxygen pump element 70*f* in such a manner that the generated voltage Vs of the equivalent voltage source 51*f* becomes the reference voltage of 450 [mV]

As a result of this, the detection signal voltage BF1, which has been corrected by biased addition of the pump current Ip so as to always become a positive value, is inputted to the microprocessor 110.

In the temperature characteristic of the internal resistance value Rs shown in FIG. 10C, the axis of ordinate represents the internal temperature of the upstream exhaust gas sensor 105*f*B, and the axis of abscissa represents the resistance value Rs of the internal resistance 52*f*.

In FIG. 10C, the internal resistance value Rs has a negative temperature characteristic, and becomes equal to or greater than several M Ω (not shown) in a cold time, but as the temperature of the exhaust gas sensor rises, the internal resistance value Rs decreases to about 220Ω at an activation start temperature of 600 degrees C. of the exhaust gas sensor, and further decreases to about 75Ω (a target resistance value) at a proper temperature of 800 degrees C.

The generated voltages Vs of the equivalent voltage sources 51*f*, 51*r* are applied to the raising resistors 60*f*, 60*r* through the internal resistances 52*f*, 52*r*.

A control power supply voltage Vcc is applied to one end of each of the raising resistors 60*f*, 60*r*.

In addition, the other end of the upstream side raising resistor 60*f* is connected to the microprocessor 110 through the amplifier 55*f* and the sensor interface circuit 115.

The detection signal voltage VS1 is generated from the amplifier 55*f* connected to the other end of the upstream side raising resistor 60*f*, and is inputted to the microprocessor 110 through the sensor interface circuit 115 as the detection signal voltage BF1.

On the other hand, the detection signal voltage BF2 is generated from the amplifier 55*r* connected to the other end of the downstream side raising resistor 60*r*, and is inputted to the microprocessor 110.

Accordingly, the downstream side detection signal voltage BF2 becomes a nonlinear output signal, as shown in FIG. 2A, but in contrast to this, the upstream side detection signal voltage BF1 becomes a linear output signal in which the pump current Ip shown in FIG. 10B is bias added.

As a result, in the upstream air fuel ratio control unit 905*a*, a digital filter circuit for determining the air fuel ratio becomes unnecessary.

Here, in cases where the amplification factor G of each of the amplifiers 55*f*, 55*r* is set to "1", the voltage value Vbf of each of the detection signal voltages VS1, BF2 of the upstream and downstream air fuel ratios is represented as shown in the following equation (6), by using the generated voltage Vs of each of the equivalent voltage sources 51*f*, 51*r*, the resistance value Rs of each of the internal resistances 52*f*, 52*r*, and the resistance value Ru of each of the raising resistors 60*f*, 60*r*.

$$Vbf = Vs + (Vcc - Vs) \times Rs / (Rs + Ru) \quad (6)$$
$$= (Vs \times Ru + Vcc \times Rs) / (Rs + Ru)$$

Similarly as stated above, in a cold time, Rs is far greater than Ru (Rs>>Ru), so Vbf becomes approximately equal to Vcc (Vbf≈Vcc), but the internal temperatures of the upstream and downstream exhaust gas sensors 105*f*B, 105*r* are raised due to the exhaust heat and the heating action of the upstream and downstream heaters 53*f*, 53*r*.

Accordingly, when the resistance value Rs of the internal resistance decreases to make it (Rs) far smaller than Ru (Rs<<Ru), Vbf becomes approximately equal to Vs (Vbf≈Vs). At this time, if the exhaust gas is in a fuel rich state, the voltage value Vbf becomes within the range of 0.5, through 1.0 [V], so a determination can be made that the activation of the upstream and downstream exhaust gas sensors 105*f*, 105*r* has been completed.

In this manner, the detection of the activation of the upstream and downstream exhaust gas sensors 105*f*B, 105*r* is carried out based on the temperature dependency of the internal resistances 52*f*, 52*r* of the upstream and downstream exhaust gas sensors 105*f*B, 105*r*, similarly as stated above.

On the other hand, at the time when the current supplied to the upstream heater 53*f* decreases to a predetermined value or less, the supply of electric power to the downstream heater 53*r* is started, and a determination of the delayed power supply time is made by the temperature dependency of the heater resistance Rh.

The value of the heater resistance Rh (see FIG. 3A) increases gradually due to the exhaust heat of the exhaust gas and the self-heating accompanying the supply of electric power to the upstream and downstream heaters 53*f*, 53*r*, so it is possible to start the supply of electric power after waiting for evaporation of the moisture of the condensed downstream heater 53*r*.

In addition, the activation time as a whole can be shortened by starting the supply of electric power to the downstream heater 53*r* without waiting for the completion of the activation of the upstream heater 53*f*.

Next, the function configuration shown in FIG. 9 will be described by focusing on the points of difference from that shown in FIG. 4.

In FIG. 9, the injector 13, the crank angle sensor 14, the catalyzer 15, the upstream and downstream exhaust gas sensors 105*f*B, 105*r*, and the upstream and downstream heaters 53*f*, 53*r* in the surroundings of the internal combustion engine 10 are arranged similarly in the above-mentioned first embodiment (FIG. 4).

In this case, however, the negative pressure sensor 17 arranged in the intake pipe 11 is added in place of the air flow sensor 12 in FIG. 4, so that an amount of intake air per second q is arithmetically calculated as a function of the engine rotational speed N and the detection signal of the negative pressure sensor 17.

Accordingly, a required valve opening time ΔT of the injector 13 is represented as shown in the following equation (7), by the use of an amount of intake air Qa, an amount of fuel injection per second f, a voluntary target air fuel ratio (BF00=Qa/F) of the fuel injection control unit 906, the amount of intake air per second q, the rotational speed N of the internal combustion engine 10, and a control parameter K.

$$\Delta T = F / f \quad (7)$$
$$= Qa / (f \times BF00)$$
$$= q / (2 \times f \times N \times BF00)$$
$$= K \times q / N$$

However, in equation (7) above, the control parameter K is represented as shown in the following equation (8).

$$K = 0.5 / (f \times BF00) \quad (8)$$

Although the vehicle mounted engine control apparatus 100B provided with the microprocessor 110 and the program memory 112B performs the control of electric power supplied to the upstream and downstream heaters 53*f*, 53*r* by means of the heater control circuit 150 and the control programs stored in the program memory 112B, the detailed operation thereof is as described in the foregoing (FIG. 5 and FIG. 6).

In addition, the program memory 112B is provided with an air fuel ratio control program, which carries out an air fuel ratio control operation (to be described later together with FIG. 11 and FIG. 12), and simple control blocks are shown in the vehicle mounted engine control apparatus 100B of FIG. 9.

In FIG. 9, the fuel injection control unit 906 controls the amount of fuel (the amount of fuel injection) F to be supplied by the injector 13 in such a manner that the amount of fuel injection F is proportional to the amount of intake air per second q arithmetically calculated from the engine rotational speed N and the detection signal of the negative pressure sensor 17, and in inverse proportion to the engine rotational speed N. In this manner, the fuel injection control unit 906 primarily operates so that the air fuel ratio BF00, which becomes an independent or voluntary target, can be obtained.

The upstream air fuel ratio control unit 905*a* generates an air fuel ratio correction value ΔBF00 (an increase or decrease correction command for the fuel supply amount F) for correcting the voluntary target air fuel ratio BF00 of the fuel injection control unit 906 in such a manner that the air fuel ratio in an upstream position corresponding to the detection signal voltage BF1 of the upstream exhaust gas sensor 105*f*B matches the first target voltage BF01 (the target air fuel ratio in the upstream position).

The downstream air fuel ratio control unit 903*a* corrects the first target voltage BF01 in such a manner that the air fuel ratio in a downstream position corresponding to an average value of the detection signal voltage BF2 of the downstream exhaust gas sensor 105*r* matches the second target voltage BF02 (the target air fuel ratio in the downstream position).

The air fuel ratio correction value ΔBF00 inputted to the fuel injection control unit 906 is set to a first initial value in which the exhaust gas becomes a fuel rich state, until the resistance value Rs of the internal resistance 52*f* of the upstream exhaust gas sensor 105*f*B decreases to generate the upstream side detection signal voltage BF1.

The first target voltage BF01 for the upstream air fuel ratio control unit 905*a* is set to a second initial value in which the exhaust gas becomes a fuel rich state, until the resistance value Rs of the internal resistance 52*r* of the downstream exhaust gas sensor 105*r* decreases to generate the downstream side detection signal voltage BF2.

The upstream air fuel ratio control unit 905*a* is composed of a third PID regulation circuit for a deviation voltage between the first target voltage BF01 and the detection signal voltage BF1.

In addition, in cases where the upstream exhaust gas sensor 105*f*B is in its unactivated state, the unactivation correction unit 905*b* to supply the first initial value to the fuel injection control unit 906 is selectively used in place of the upstream air fuel ratio control unit 905*a*.

The downstream air fuel ratio control unit 903*a* is composed of a second digital filter circuit for a deviation voltage between the second target voltage BF02 and the detection signal voltage BF2, and a second PID regulation circuit.

In addition, in cases where the downstream exhaust gas sensor 105*r* is in its unactivated state, the unactivation correction unit 903*b* to supply the second initial value to the upstream air fuel ratio control unit 905*a* is selectively used in place of the downstream air fuel ratio control unit 903*a*.

The activation detection unit 901*a* makes a determination that the downstream exhaust gas sensor 105*r* has been activated, by detecting when the detection signal voltage BF2 of the downstream exhaust gas sensor 105*r* has changed from an L (low) level to an H (high) level.

The inactive abnormality detection unit 901*b* makes a determination that the downstream exhaust gas sensor 105*r* is in a state of inactive abnormality, by detecting when the detection signal voltage BF2 of the downstream exhaust gas sensor 105*r* does not change from an L (low) level to an H (high) level even if a predetermined determination time has passed after electric power is supplied to the downstream heater 53*r*.

In response to the inactive abnormality detection unit 901*b* having detected the inactive abnormality state of the downstream exhaust gas sensor 105*r*, the inactivity correction unit 903*c* inputs a predetermined alternative signal voltage, in place of the first target voltage BF01 generated by the downstream air fuel ratio control unit 903*a*, to the upstream air fuel ratio control unit 905*a*.

The activation detection unit 904*a* determines that the upstream exhaust gas sensor 105*f*B has been activated, by detecting when the detection signal voltage BF1 of the upstream exhaust gas sensor 105*f*B has changed from a lean (low) level to a rich (high) level.

In addition, the inactive abnormality detection unit 904*b* makes a determination that the upstream exhaust gas sensor 105*f*B is in a state of inactive abnormality, by detecting that the detection signal voltage BF1 of the upstream exhaust gas sensor 105*f*B does not change from a lean (low) level to a rich (high) level even if a predetermined determination time has passed after electric power is supplied to the upstream heater 53*f*.

In response to the inactive abnormality detection unit 904*b* having detected the inactive abnormality state of the upstream exhaust gas sensor 105*f*B, the inactivity correction unit 905*c* inputs a predetermined alternative signal voltage, in place of the air fuel ratio correction value ΔBF00 generated by the upstream air fuel ratio control unit 905*a*, to the fuel injection control unit 906.

In cases where the state in which the output generated by the downstream air fuel ratio control unit 903*a* is out of a predetermined upper and lower limit range continues over a predetermined time or more, the control abnormality detection unit 903*d* makes a determination that the downstream air fuel ratio control unit 903*a* is abnormal.

In cases where the state in which the output generated by the upstream air fuel ratio control unit 905*a* is out of a predetermined upper and lower limit range continues over a predetermined time or more, the control abnormality detection unit 905*d* makes a determination that the upstream air fuel ratio control unit 905*a* is abnormal.

In response to the control abnormality detection unit 903*d* having detected the abnormal state of the downstream air fuel ratio control unit 903*a*, the inactivity correction unit 903*c* inputs a predetermined alternative signal voltage, in place of the first target voltage BF01 generated by the downstream air fuel ratio control unit 903*a*, to the upstream air fuel ratio control unit 905*a*.

In addition, in response to the control abnormality detection unit 905*d* having detected the abnormal state of the upstream air fuel ratio control unit 905*a*, the inactivity correction unit 905*c* inputs a predetermined alternative signal voltage, in place of the air fuel ratio correction value ΔBF00 generated by the upstream air fuel ratio control unit 905*a*, to the fuel injection control unit 906.

Here, note that when a fuel cut is carried out in a coasting operation or a downhill (descending) operation, a fuel cut detection unit (not shown) is operated in place of the control abnormality detection units 903*d*, 905*d*, so that an air fuel ratio control operation is stopped.

In addition, the program memory 112B is provided with a control program which acts as the learning storage unit 907.

The learning storage unit 907 stores an average value of a plurality of latest output values of the downstream air fuel ratio control unit 903*a* or the upstream air fuel ratio control unit 905*a*, which have been stored in a sequential manner, corresponding to the amount of intake air Qa arithmetically calculated from the rotational speed N of the internal combustion engine 10 and the detection signal of the negative pressure sensor 17, and to the rotational speed N of the internal combustion engine 10 detected by the pulse interval (or pulse generation density) of the crank angle sensor 14.

An average value of measured data, which have been learned and stored by the learning storage unit 907 during the time when the downstream and upstream exhaust gas sensors 105*r*, 105*f*B are operating in a normal manner, is applied as the alternative signal voltages which are applied in the inactivity correction units 903*c*, 905*c*.

The learning storage unit 907 stores an average value of a plurality of latest output values of the downstream air fuel ratio control unit 903*a* or the upstream air fuel ratio control unit 905*a*, which have been stored in a sequential manner, corresponding to at least one of the amount of intake air Qa and the rotational speed N of the internal combustion engine 10.

An average value of measured data, which have been learned and stored by the learning storage unit 907 during the time when the downstream and upstream exhaust gas sensors 105*r*, 105*f*B and the downstream and upstream air fuel ratio control units 903*a*, 905*a* are operating in a normal manner, is applied as the alternative signal voltage which is applied in the downstream or upstream inactivity correction unit 903*c*, 905*c*.

Next, reference will be made to an operation according to this second embodiment of the present invention, as shown in FIG. 8.

In FIG. 8, first, when a power switch (not shown) is closed, the power supply switching element 102 is closed, and the drive power supply voltage Vb from the external power supply 101 is applied to the vehicle mounted engine control apparatus 100B, whereby the control power supply voltage Vcc stabilized through the constant voltage power supply circuit 120 is supplied to the microprocessor 110.

The microprocessor 110 controls the electric load group 104 and the upstream and downstream heaters 53*f*, 53*r* based on the detection signals from the input sensor group 106, the operating states of the upstream and downstream exhaust gas sensors 105*f*B, 105*r*, and the input and output control program stored in the program memory 112B.

In addition, the microprocessor 110 makes an abnormality determination with respect to the input sensor group 106 of various kinds of sensors including the upstream and downstream exhaust gas sensors 105*f*B, 105*r*, and the electric load group 104 of various kinds of electric loads including the upstream and downstream heaters 53*f*, 53*r*, drives the alarm indicator 103 at the time of occurrence of abnormality, and notifies it to the driver of a vehicle.

Although the control operation of the upstream and downstream heaters 53*f*, 53*r* is as shown in the flow charts (FIG. 5, FIG. 6) of the above-mentioned first embodiment, an overall control operation thereof will be described here, while referring to timing charts in FIGS. 11A through 11H.

In FIGS. 11A through 11H, FIG. 11A shows the switching action of the power supply switching element 102, FIG. 11B shows the current of the upstream heater 53*f*, FIG. 11C shows the current of the downstream heater 53*r*, FIG. 11D shows the activated state of the upstream exhaust gas sensor 105*f*, FIG. 11E shows the activated state of the downstream exhaust gas sensor 105*r*, FIG. 11F shows the upstream air fuel ratio correction value ΔBF00, FIG. 11G shows the first (upstream) target voltage BF01, and FIG. 11H shows an upstream abnormality occurrence state detected by the inactive abnormality detection unit 904*b* or the control abnormality detection unit 905*d*.

FIG. 11A shows that the power supply switching element 102 in FIG. 8 is closed, and at time point t1, a determination of a driving requirement for starting the control of power supply to the upstream heater 53*f* (a requirement for avoiding unnecessary heating control, in which the engine rotational speed N and the engine temperature are both within a prescribed appropriate range) has been completed.

FIG. 11B shows the current change of the upstream heater 53*f* in which the upstream switching element 50*f* is closed at time point t1, and after electric power is supplied to the upstream heater 53*f*, the heater resistance Rh increases in accordance with the temperature rise of the upstream heater 53*f*, whereby the current of the upstream heater 53*f* decreases according to the characteristic shown in FIG. 3B.

FIG. 11C shows the current change of the downstream heater 53*r* in which the downstream switching element 50*r* is closed at time point t2, and after electric power is supplied to the downstream heater 53*r*, the heater resistance Rh increases in accordance with the temperature rise of the downstream heater 53*r*, whereby the current of the downstream heater 53*r* decreases according to the characteristic shown in FIG. 3B. Here, note that in step 602 in FIG. 6, the time point t2 is determined by that the current of the upstream heater 53*f* has decreased to the predetermined value or less.

FIG. 11D shows that the upstream exhaust gas sensor 105*f*B is activated at time point t3, and FIG. 11E shows that the downstream exhaust gas sensor 105*r* is activated at time point t4.

Here, note that in cases where the engine is restarted after it was operated only for a short time, the activation timing (time point t3) of the upstream exhaust gas sensor 105*f*B and the electric power supply start timing (time point t2) of the downstream heater 53*r* can delicately come near to each other under the influence of the remaining heat of the engine.

However, at least the requirement for starting the supply of electric power to the downstream heater 53*r* is unrelated to whether the upstream exhaust gas sensor 105*f*B is activated, so the supply of electric power to the downstream heater 53*r* is started in response to when the current supplied to the upstream heater 53*f* decreases to the predetermined set threshold or below.

However, a large value in proportion to the drive power supply voltage Vb is applied to the set threshold that is used as a comparison reference for the supply current of the upstream heater 53*f*, so for example, at the time when the temperature of the upstream heater 53*f* rises to 400 degrees C., the supply of electric power to the downstream heater 53*r* is started (see FIG. 3B).

In this manner, the supply of electric power to the downstream heater 53*r* is started without waiting for the completion of activation of the upstream exhaust gas sensor 105*f*B, whereby the activation of the downstream exhaust gas sensor 105*r* is also carried out at an early stage.

FIG. 11F shows the change of the upstream side air fuel ratio correction value ΔBF00 with respect to the fuel injection control unit 906 in FIG. 9.

As the air fuel ratio correction value ΔBF00, the first initial value by means of the unactivation correction unit 905*b* is applied until the activation time point t3 of the upstream exhaust gas sensor 105*f*B, and after the activation (time point t3) of the upstream exhaust gas sensor 105*f*B, a negative feedback control output by means of the upstream air fuel ratio control unit 905*a* is applied. After the occurrence of abnormality (time point t5), a correction learning value by means of the inactivity correction unit 905*c* is applied.

FIG. 11G shows the change of the first target voltage BF01 with respect to the upstream air fuel ratio control unit 905*a* in FIG. 9.

As the first target voltage BF01, the second initial value by means of the unactivation correction unit 903*b* is applied until the activation time point t4 of the downstream exhaust gas sensor 105*r*, and after the activation (time point t4) of the downstream exhaust gas sensor 105*r*, a negative feedback control output by means of the downstream air fuel ratio control unit 903*a* is applied. After the occurrence of abnormality (time point t5), the control is stopped.

FIG. 11H shows that at time point t5, the inactive abnormality detection unit 904*b* detected the abnormality of the upstream exhaust gas sensor 105*f*B, or the control abnormality detection unit 905*d* detected the abnormality of the upstream air fuel ratio control unit 905*a* (the occurrence of upstream abnormality).

With this occurrence of upstream abnormality, the correction learning value by means of the inactivity correction unit 905*c* is applied as the air fuel ratio correction value ΔBF00 in FIG. 11F, and the negative feedback control in FIG. 11G is stopped.

Here, note that in cases where the abnormality of the downstream exhaust gas sensor 105*r* or the abnormality of the downstream air fuel ratio control unit 903*a* (downstream abnormality) occurs, the correction learning value by means of the inactivity correction unit 903*c* is supplied to the upstream air fuel ratio control unit 905*a* as the first target voltage BF01.

Next, reference will be made to an air fuel ratio control operation according to the second embodiment of the present invention shown in FIG. 8, while referring to a flow chart of FIG. 12 together with a functional block diagram in FIG. 9.

Figure 12:
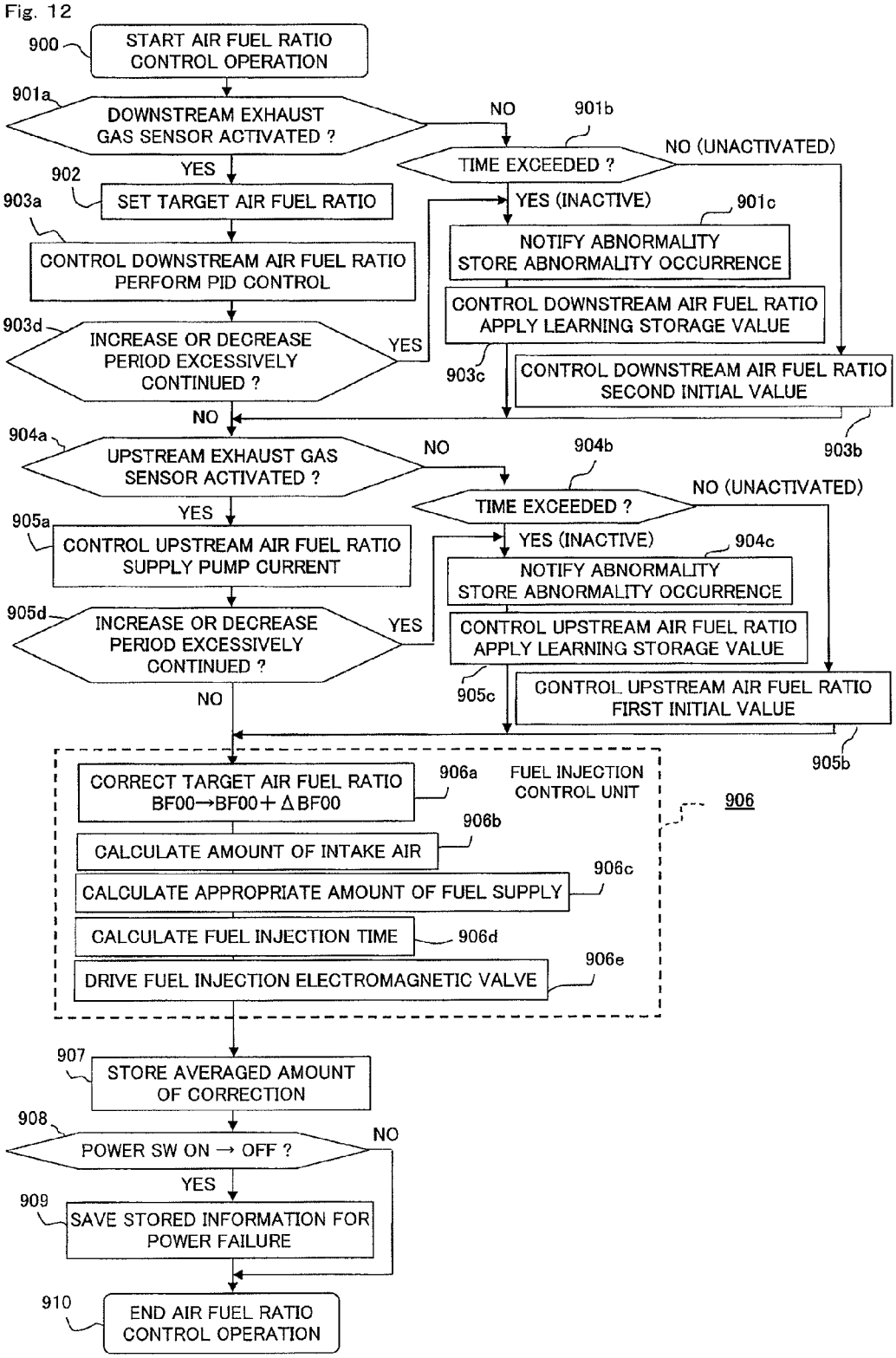
FIG. 12 is a flow chart for explaining an air fuel ratio control operation according to the second embodiment of the present invention.

In FIG. 12, individual steps 900, 901*a* through 901*c*, 902, 903*a*, 903*c*, 904*a* through 904*c*, 905*c*, 906, 906*a* through 906*e*, and 907 through 910 perform the same processing functions as those of the steps 700, 701*a* through 701*c*, 702, 703*a*, 703*c*, 704*a* through 704*c*, 705*c*, 706, 706*a* and through 706*e*, 707 through 710, respectively, in the above-mentioned first embodiment (FIG. 7), with each symbol "70X" being only replaced by "90X".

First, in FIG. 12, step 900 is an operation start step in which the microprocessor 110 starts air fuel ratio control, and the following step 901*a* (the activation detection unit) is a step which determines whether the downstream exhaust gas sensor 105*r* is in its activated state.

In step 901*a*, when the downstream exhaust gas sensor 105*r* is in its activated state, a positive determination ("YES") is made, and the control flow shifts to step 902, whereas when the downstream exhaust gas sensor 105*r* is not in its activated state, a negative determination ("NO") is made, and the control flow shifts to step 901*b*.

Here, note that in step 901*a*, by detecting when the detection signal voltage bF2 of the downstream exhaust gas sensor 105*r* has changed, for example, from an H (high) level of 4.5 [V] or more to an L (low) level of from 0.5 to 1.0 [V], a determination is made that the downstream exhaust gas sensor 105*r* has been activated.

In step 901*b* (the inactive abnormality detection unit), when a timing timer (not shown) is started and exceeds a predetermined time, a positive determination ("YES") is made, and the control flow shifts to step 901*c*, whereas when the timer does not exceeds the predetermined time, a negative determination ("NO") is made, and the control flow shifts to step 903*b*.

Here, note that the "NO" determination in step 901*b* means that the downstream exhaust gas sensor 105*r* does not reached its activation temperature (i.e., is in its unactivated state), and the "YES" determination in step 901*b* means that the downstream exhaust gas sensor 105*r* is still not activated (i.e., is in its abnormal state) even if a sufficient heating time has elapsed.

In addition, in cases where the downstream exhaust gas sensor 105*r* is once activated to perform a normal operation, when the detection signal voltage BF2 of the downstream exhaust gas sensor 105*r* does not change from the "L" level to the "H" level, or also when it does not change from the "H" level to the "L" level, a determination is made that the downstream exhaust gas sensor 105*r* is in an "inactive abnormality state".

In step 901*c*, an abnormality notification command is generated to drive the alarm indicator 103, and at the same time, abnormality occurrence information is stored into a predetermined address in the RAM memory 111 according to factors.

In step 902 (the target air fuel ratio setting unit), the second target voltage BF02 is set, and in the following step 903*a* (the downstream air fuel ratio control unit), second PID control is started.

In the following step 903*d* (the control abnormality detection unit), it is determined whether a changing (increase or decrease) period continues excessively.

Specifically, in cases where the logic level of a second PID control input (detection signal voltage BF2) in step 903*a* continues one of the L level and the H level over a predetermined time or more (i.e., at the time of occurrence of excessive continuation), a positive determination ("YES") is made, and the control flow shifts to step 901*c*, whereas when a normal PID control operation is started within the predetermined time, a negative determination ("NO") is made, and the control flow shifts to step 904*a*.

In step 903*c* following the step 901*c*, an alternate setting value is applied in place of the second PID control output in step 903*a*, and the control flow shifts to step 904*a*.

This alternate setting value is calculated based on a learning storage value stored in step 907 to be described later. That is, an alternate setting value corresponding to the current engine rotational speed N and the amount of intake air Qa is calculated by means of interpolation calculation.

In step 903*b* (the unactivation correction unit) which is executed in cases where the negative determination ("NO") (i.e., the downstream exhaust gas sensor 105*r* is in its unactivated state) is made in step 901*b*, the second initial value is applied in place of the second PID control output in step 903*a*, and the control flow shifts to step 904*a*.

At this time, the second initial value by means of the unactivation correction unit 903*b* is applied as the first target voltage BF01 for step 905*a* (the upstream air fuel ratio control unit), in place of the second PID control output by means of step 903*a* (the downstream air fuel ratio control unit).

Steps 904*a* through 905*d* are related to upstream air fuel ratio control, and among these steps, steps 904*a*, 904*b* and 904*c* correspond to the steps 901*a*, 901*b* and 901*c*, respectively, of downstream air fuel ratio control, and steps 905*a*, 905*b*, 905*c* and 905*d* correspond to the steps 903*a*, 903*b*, 903*c* and 903*d*, respectively, of the downstream air fuel ratio control.

However, in the step 903*a* of the downstream air fuel ratio control, second PID control is carried out by means of an output of the second digital filter circuit for the deviation voltage between the nonlinear detection signal voltage BF2 and the second target voltage BF02, but in contrast to this, in the step 905*a* of the upstream air fuel ratio control, third PID control is carried out based on a deviation voltage between the linear detection signal voltage BF1 outputted from the sensor interface circuit 115, and the first target voltage BF01.

Accordingly, the step 904*a* corresponds to the activation detection unit; the step 904*b* corresponds to the inactive abnormality detection unit; the step 905*a* corresponds to the air fuel ratio control units; the step 905*b* corresponds to the unactivation correction unit; the step 905*c* corresponds to the inactivity correction unit; and the step 905*d* corresponds to the control abnormality detection unit.

A third PID control output from the upstream air fuel ratio control unit 905*a*, or the first initial value from the unactivation correction unit 905*b*, or the alternate setting value from the inactivity correction unit 905*c* is applied as the air fuel ratio correction value ΔBF00 for the fuel injection control unit 906.

In the following step block 906 (the fuel injection control unit), first, in step 906*a*, a value "BF00+ΔBF00", which is obtained by adding the air fuel ratio correction value ΔBF00 to the voluntary target air fuel ratio BF00, is applied in place of the voluntary target air fuel ratio BF00 shown in the above-mentioned equation (7).

In the following step 906*b*, the amount of intake air Qa is calculated, and in the following step 906*c*, an appropriate amount of fuel supply F is calculated. In the following step 906*d*, the valve opening time ΔT of the injector 13 is calculated, and in the following step 906*e*, the fuel injection electromagnetic valve of the injector 13 is driven at timing in response to the crank angle sensor 14.

In the following step 907 (the learning storage unit), the air fuel ratio correction value ΔBF00, which is the PID control output from each of the upstream and downstream air fuel ratio control units 905*a*, 903*a*, and the value of the first target voltage BF01 are read out in a sampling manner, and the engine rotational speed N of the internal combustion engine 10, and the average value of the first target voltage BF01 and the air fuel ratio correction value ΔBF00 corresponding to the value of the amount of intake air per second q are stored into the RAM memory 111.

The following step 908 is a step to determine whether the power switch (not shown) has been changed from its close state to its open state, and when the power switch has not been changed while maintaining its close state, a negative determination ("NO") is made, and the control flow shifts to an operation end step 910, whereas when the power switch has been changed into its open state, a positive determination ("YES") is made, and the control flow shifts to step 909.

In step 909, abnormality occurrence storage information by means of the above-mentioned steps 508, 608 (FIG. 5 and FIG. 6), abnormality occurrence storage information by means of the steps 901*c*, 904*c* in FIG. 12, and learning storage information by means of the step 907 are transmitted to and stored in the nonvolatile data memory 113, and then the control flow shifts to the operation end step 910.

Here, note that in the execution process of step 909, the power switch is opened, but the power supply switching element 102 is still closed.

Accordingly, after the processing of transmitting and saving preserved data to the data memory 113 is finished, the power supply switching element 102 is opened and the operation of the microprocessor 110 is stopped.

In addition, if the power switch is in its closed state, the microprocessor 110 executes other control programs in the operation end step 910, returns to the operation start step 900 again within a predetermined time, so that it executes the steps of the control flow between the operation start step 900 and the operation end step 910 in a repeated manner.

Here, note that in FIG. 1 and FIG. 8, the upstream and downstream exhaust gas sensors 105*f*B, 105*r* have their negative lines connected to the vehicle body grand GND to which a negative terminal of the external power supply 101 (vehicle mounted battery) is connected, but they can be connected to the vehicle mounted engine control apparatus 100A or 100B in place of the vehicle body grand GND, so that a bias voltage of about 0.5 [V], for example, can also be applied thereto in the inside of the vehicle mounted engine control apparatus 100A or 100B. In this case, it is necessary to make the voltage level for an activation determination larger by the value of the bias addition.

Moreover, although the positive terminals of the upstream and downstream exhaust gas sensors 105*f*B, 105*r* in FIG. 8 are connected to the raising resistors 60*f*, 60*r*, respectively, they may instead be connected to the reduction resistors 54*f*, 54*r*, respectively, as shown in FIG. 1, in place of the raising resistors 60*f*, 60*r*. In any case, the circuit arrangement is to prevent the mixing of noise due to one end of each signal line being formed as an open end.

On the other hand, it is also possible to use the air fuel ratio correction coefficient Kc, similar to that shown in FIG. 4, in place of the air fuel ratio correction value ΔBF00 for the fuel injection control unit 906 in FIG. 9.

In this case, the following equation (9) holds.

$$BF00+\Delta BF00=BF00(1+\Delta BF00/BF00) \tag{9}$$

Therefore, the air fuel ratio correction coefficient Kc corresponds to the following equation (10).

$$Kc=1+\Delta BF00/BF00 \tag{10}$$

In addition, the corrected amount of fuel supply Fx is represented as shown in the following equation (11), by using the amount of intake air Qa, the amount of fuel supply F, the voluntary target air fuel ratio BF00 (=Qa/F), and the air fuel ratio correction coefficient Kc.

$$\begin{aligned} Fx &= Qa/(Kc\times BF00) \\ &= F/Kc \end{aligned} \tag{11}$$

From equation (11) above, it can be seen that a correction coefficient 1/Kc with respect to the amount of fuel supply F becomes the reciprocal of the air fuel ratio correction coefficient Kc with respect to the air fuel ratio.

From the above correlation, commands with respect to the value of the air fuel ratio correction coefficient Kc or the air fuel ratio correction value ΔBF00 are generically named as commands for increasing or decreasing (i.e., increase or decrease correction commands) for the amount of fuel supply F.

As described above, connected to the vehicle mounted engine control apparatus 100B according to the second embodiment (FIG. 8 through FIG. 12) of the present invention are the upstream and downstream exhaust gas sensors 105*f*B, 105*r* that are arranged in an upstream position and a downstream position, respectively, of the catalyzer 15 arranged in the exhaust passage of the internal combustion engine 10, and generate the nonlinear or linear detection signal voltages BF1, BF2 corresponding to the air fuel ratio A/F which is the ratio (Qa/F) of the amount of intake air Qa to the amount of fuel supply F, and the upstream and downstream heaters 53*f*, 53*r* to which electric power is supplied so as to activate the upstream and downstream exhaust gas sensors 105*f*B, 105*r* at an early stage, at the time when a predetermined requirement is satisfied.

The vehicle mounted engine control apparatus 100B is provided with: the microprocessor 110 that cooperates with the program memory 112B to execute the fuel injection control unit 906, the upstream air fuel ratio control unit 905*a* and the downstream air fuel ratio control unit 903*a*; and the heater control circuit 150.

The heater control circuit 150 is provided with the upstream and downstream switching elements 50*f*, 50*r* which are driven and controlled by the microprocessor 110 so as to supply electric power to the upstream and downstream heaters 53*f*, 53*r*, and the current sensing resistors 57*f*, 57*r* for supplying the heater current detection signals Cf, Cr to the microprocessor 110.

The fuel injection control unit 906 adjusts the valve opening time ΔT of the injector 13, which is the electromagnetic coil for driving the fuel injection electromagnetic valve, thereby to control the amount of fuel injection, in proportion to the amount of intake air Qa, which is arithmetically calculated from the rotational speed N of the internal combustion engine 10 and the detection value of the negative pressure sensor 17 which is arranged in the intake pipe 11, and controls the amount of fuel supply F in such a manner that the predetermined voluntary target air fuel ratio BF00 can be obtained.

The upstream air fuel ratio control unit 905*a* generates to the fuel injection control unit 906 a correction command to increase or decrease the amount of fuel supply F in such a manner that the air fuel ratio in an upstream position corresponding to the detection signal voltage BF1 obtained from the upstream exhaust gas sensor 105*f*B matches the first target voltage BF01 (the target air fuel ratio in the upstream position).

The downstream air fuel ratio control unit 903*a* corrects the first target voltage BF01 in such a manner that the air fuel ratio in a downstream position corresponding to the detection signal voltage BF2 obtained from the downstream exhaust gas sensor 105*r* matches the second target voltage BF02 (the target air fuel ratio in the downstream position).

At the time when the supply current to the upstream heater 53*f* declines to the predetermined value or less in accordance with the temperature rise of the upstream heater 53*f* to which electric power has first been supplied, the supply of electric power to the downstream heater 53*r* is started even if the upstream exhaust gas sensor 105*f*B is still in its unactivated state.

The value of the voluntary target air fuel ratio of the fuel injection control unit 906 is set to the first initial value in which the exhaust gas becomes a fuel rich state, until the resistance value Rs of the internal resistance 52*f* of the upstream exhaust gas sensor 105*f* decreases to generate the upstream side detection signal voltage BF1.

The first target voltage BF01 for the upstream air fuel ratio control unit 905*a* is set to the second initial value in which the exhaust gas becomes a fuel rich state, until the resistance value Rs of the internal resistance 52*r* of the downstream exhaust gas sensor 105*r* decreases to generate the downstream side detection signal voltage BF2.

In addition, the vehicle mounted engine control apparatus 100B according to the second embodiment of the present invention is provided, as the program memory 112B, with a control program that serves as the unactivation correction unit 905*b* (first unactivation correction unit) to supply the first initial value to the fuel injection control unit 906, and a control program that serves as the unactivation correction unit 903*b* (second unactivation correction unit) to supply the second initial value to the upstream air fuel ratio control unit 905*a*.

The upstream air fuel ratio control unit 905*a* is provided with the sensor interface circuit 115 that generates the linear detection signal voltage BF1 proportional to the air fuel ratio, from the nonlinear detection signal voltage VS1 generated by the upstream exhaust gas sensor 105*f*B.

In addition, the upstream air fuel ratio control unit 905*a* is provided with the third PID regulation circuit that performs negative feedback control by using, as an input, the deviation voltage between the linear detection signal voltage BF1 from the sensor interface circuit and the first target voltage BF01, or a first digital filter circuit that is related to a deviation voltage between the first target voltage BF01 and the nonlinear detection signal voltage VS1, and a first PID regulation circuit.

When the upstream exhaust gas sensor 105*f*B is in its unactivated state, the unactivation correction unit 905*b* to supply the first initial value to the fuel injection control unit 906 is selectively used in place of the upstream air fuel ratio control unit 905*a*.

The downstream air fuel ratio control unit 903*a* is composed of the second digital filter circuit related to the deviation voltage between the second target voltage BF02 and the nonlinear detection signal voltage BF2, and the second PID regulation circuit.

When the downstream exhaust gas sensor 105*r* is in its unactivated state, the unactivation correction unit 903*b* to supply the second initial value to the upstream air fuel ratio control unit 905*a* is selectively used in place of the downstream air fuel ratio control unit 903*a*.

As described above, according to the second embodiment (claim 3) of the present invention, the unactivation correction units 905*b*, 903*b* to generate the first and second initial values, respectively, are used in place of the upstream and downstream air fuel ratio control units 905*a*, 903*a*, respectively, which are used at the time when the upstream and downstream exhaust gas sensors 105*f*B, 105*r* are in their unactivated states, as a result of which it is possible to prevent an excessively fuel rich operation of the internal combustion engine 10 when the upstream and downstream exhaust gas sensors 105*f*B, 105*r* are in their unactivated states.

In addition, the initial values can be set in a prompt manner without being affected by the influence of a response delay in the integration signal voltages of the PID regulation circuits.

Moreover, according to the second embodiment (claim 4) of the present invention is provided with a control program that serves as the activation detection units 901*a*, 904*a* related to the downstream and upstream exhaust gas sensors 105*r*, 105*f*B, a control program that serves as the inactive abnormality detection units 901*b*, 904*b*, and a control program that serves as the inactivity correction units 903*c*, 905*c*.

The downstream activation detection unit 901*a* determines that the downstream exhaust gas sensor 105*r* has been activated, by detecting when the detection signal voltage BF2 of the downstream exhaust gas sensor 105*r* has changed from a lean (low) level to a rich (high) level, or from a rich (high) level to a lean (low) level.

The downstream inactive abnormality detection unit 901*b* determines that the downstream exhaust gas sensor 105*r* is in an inactive abnormality, by detecting that the detection signal voltage BF2 of the downstream exhaust gas sensor 105*r* has not changed from a lean (low) level to a rich (high) level, or from a rich (high) level to a lean (low) level even if a predetermined determination time has elapsed after electric power is supplied to the downstream heater 53*r*.

In response to the inactive abnormality detection unit 901*b* having detected the inactive abnormality state of the downstream exhaust gas sensor 105*r*, the downstream inactivity correction unit 903*c* inputs a predetermined alternative signal voltage, in place of the first target voltage BF01 generated by the downstream air fuel ratio control unit 903*a*, to the upstream air fuel ratio control unit 905*a*.

The upstream activation detection unit 904*a* determines that the upstream exhaust gas sensor 105*f*B has been activated, by detecting when the detection signal voltage BF1 of the upstream exhaust gas sensor 105*f*B has changed from a lean (low) level to a rich (high) level, or from a rich (high) level to a lean (low) level.

The upstream inactive abnormality detection unit 904*b* determines that the upstream exhaust gas sensor 105*f*B is in an inactive abnormality, by detecting that the detection signal voltage BF1 of the upstream exhaust gas sensor 105*f*B has not changed from a lean (low) level to a rich (high) level, or from a rich (high) level to a lean (low) level even if a predetermined determination time has elapsed after electric power is supplied to the upstream heater 53*f*.

In response to the inactive abnormality detection unit 904*b* having detected the inactive abnormality state of the upstream exhaust gas sensor 105*f*B, the upstream inactivity correction unit 905*c* inputs a predetermined alternative signal voltage, in place of a correction command to increase or decrease the amount of fuel supply F generated by the upstream air fuel ratio control unit 905*a*, to the fuel injection control unit 906.

Further, the program memory 112B according to the second embodiment (claim 5) of the present invention is provided with a control program that serves as the control abnormality detection units 903*d*, 905*d* for the downstream and upstream air fuel ratio control units 903*a*, 905*a* which operate at the time when the engine is not in a fuel cut operating state.

The downstream control abnormality detection unit 903*d* makes a determination that the downstream air fuel ratio control unit 903*a* is abnormal, in cases where the state in which the output generated by the downstream air fuel ratio control unit 903*a* is out of a predetermined upper and lower limit range continues over a predetermined time or more, and where the inactive abnormality detection unit 901*b* for the downstream exhaust gas sensor 105*r* does not detect any abnormality.

The upstream control abnormality detection unit 905*d* makes a determination that the upstream air fuel ratio control unit 905*a* is abnormal, in cases where the state in which the output generated by the upstream air fuel ratio control unit 905*a* is out of a predetermined upper and lower limit range continues over a predetermined time or more, and where the inactive abnormality detection unit 904*b* for the upstream exhaust gas sensor 105*f*B does not detect any abnormality.

In response to the downstream control abnormality detection unit 903*d* having detected the abnormal state of the downstream air fuel ratio control unit 903*a*, the downstream inactivity correction unit 903*c* inputs a predetermined alternative signal voltage, in place of the first target voltage BF01 generated by the downstream air fuel ratio control unit 903*a*, to the upstream air fuel ratio control unit 905*a*.

In response to the upstream control abnormality detection unit 905*d* having detected the abnormal state of the upstream air fuel ratio control unit 905*a*, the upstream inactivity correction unit 905*c* inputs a predetermined alternative signal voltage, in place of the correction command to increase or decrease the amount of fuel supply F generated by the upstream air fuel ratio control unit 905*a*, to the fuel injection control unit 906.

Furthermore, the program memory 112B according to the second embodiment (claim 6) of the present invention is provided with a control program that serves as the learning storage unit 907.

The learning storage unit 907 stores an average value of a plurality of latest output values of the downstream air fuel ratio control unit 903*a* or the upstream air fuel ratio control unit 905*a*, which have been stored in a sequential manner, corresponding to at least one of the amount of intake air Qa and the rotational speed N of the internal combustion engine 10.

An average value of measured data, which have been learned and stored by the learning storage unit 907 during the time when the downstream and upstream exhaust gas sensors 105*r*, 105*f*B and the downstream and upstream air fuel ratio control units 903*a*, 905*a* are operating in a normal manner, is applied as the alternative signal voltage which is applied in the downstream or upstream inactivity correction unit 903*c*, 905*c*.

What is claimed is:

1. A vehicle mounted engine control apparatus, to which are connected a pair of upstream and downstream exhaust gas sensors that are arranged in an upstream position and a downstream position of a catalyzer which is arranged in an exhaust passage of the internal combustion engine, and each generate a nonlinear or linear detection signal voltage corresponding to an air fuel ratio of an exhaust gas in the exhaust passage, and a pair of upstream and downstream heaters to which electric power is supplied at the time when a predetermined requirement is satisfied, in order to activate the upstream and downstream exhaust gas sensors at an early stage, the vehicle mounted engine control apparatus comprising:

a microprocessor that cooperates with a program memory to execute a fuel injection control unit, an upstream air fuel ratio control unit and a downstream air fuel ratio control unit; and a heater control circuit that includes a pair of upstream and downstream switching elements which are driven and controlled by the microprocessor so as to supply electric power to the upstream and downstream heaters, and a pair of current sensing resistors for supplying heater current detection signals to the microprocessor;

wherein the fuel injection control unit adjusts the valve opening time of a injector, which is an electromagnetic coil for driving a fuel injection electromagnetic valve, thereby to control an amount of fuel injection, in proportion to the amount of intake air, which is detected by an air flow sensor arranged in an intake passage of the internal combustion engine, or which is arithmetically calculated from the detection value of a rotation sensor which generates a pulse signal corresponding to the rotational speed of the internal combustion engine and the detection value of a negative pressure sensor which is arranged in an intake pipe, whereby the amount of fuel supply is controlled so as to obtain a predetermined voluntary target air fuel ratio;

wherein the upstream air fuel ratio control unit generates to the fuel injection control unit a correction command to increase or decrease the amount of fuel supply in such a manner that an air fuel ratio in an upstream position corresponding to the detection signal voltage obtained from the upstream exhaust gas sensor matches a first target voltage which is a target air fuel ratio in the upstream position;

wherein the downstream air fuel ratio control unit corrects the first target voltage in such a manner that an air fuel ratio in a downstream position corresponding to the detection signal voltage obtained from the downstream exhaust gas sensor matches a second target voltage which is a target air fuel ratio in the downstream position;

wherein at the time when the supply current to the upstream heater declines to a predetermined value or less in accordance with a temperature rise of the upstream heater to which electric power has first been supplied, the supply of electric power to the downstream heater is started even if the upstream exhaust gas sensor is still in its unactivated state;

wherein the value of the voluntary target air fuel ratio of the fuel injection control unit is set to a first initial value in which the exhaust gas becomes a fuel rich state, until the resistance value of an internal resistance of the upstream exhaust gas sensor decreases to generate an upstream side detection signal voltage; and wherein the first target voltage for the upstream air fuel ratio control unit is set to a second initial value in which the exhaust gas becomes a fuel rich state, until the resistance value of an internal resistance of the downstream exhaust gas sensor decreases to generate a downstream side detection signal voltage.

2. The vehicle mounted engine control apparatus as set forth in claim 1, wherein the upstream air fuel ratio control unit is composed of a first digital filter circuit that is related to a deviation voltage between the first target voltage and the nonlinear detection signal voltage, and a first PID regulation circuit that performs negative feedback control, or the upstream air fuel ratio control unit is composed of a sensor interface circuit that obtains a linear signal voltage proportional to the air fuel ratio, and a third PID regulation circuit to which a deviation voltage between the linear signal voltage and the first target voltage is inputted;

wherein an output voltage of the first or third PID regulation circuit is restricted so as not to be a rich command output in which the output voltage is equal to or larger than a first upper limit value, and the first initial value for the fuel injection control unit at the time when the upstream exhaust gas sensor is in its unactivated state is decided by the first upper limit value;

wherein the downstream air fuel ratio control unit is composed of a second digital filter circuit that is related to a deviation voltage between the second target voltage and the nonlinear detection signal voltage, and a second PID regulation circuit; and wherein an output voltage of the second PID regulation circuit is restricted so as not to be a rich command output in which the output voltage is equal to or larger than a second upper limit value, and the second upper limit value becomes the second initial value for the upstream air fuel ratio control unit at the time when the downstream exhaust gas sensor is in its unactivated state.

3. The vehicle mounted engine control apparatus as set forth in claim 1, wherein the program memory is provided with a control program that serves as a first unactivation correction unit to supply the first initial value to the fuel injection control unit, and a control program that serves as a second unactivation correction unit to supply the second initial value to the upstream air fuel ratio control unit;

wherein the upstream air fuel ratio control unit is composed of a sensor interface circuit that generates a linear detection signal voltage proportional to the air fuel ratio, from the nonlinear detection signal voltage generated by the upstream exhaust gas sensor, and a third PID regulation circuit that performs negative feedback control by using, as an input, a deviation voltage between the linear detection signal voltage from the sensor interface circuit and the first target voltage, or the upstream air fuel ratio control unit is composed of a first digital filter circuit that is related to a deviation voltage between the first target voltage and the nonlinear detection signal voltage, and a first PID regulation circuit;

wherein when the upstream exhaust gas sensor is in its unactivated state, the first unactivation correction unit is selectively used in place of the upstream air fuel ratio control unit;

wherein the downstream air fuel ratio control unit is composed of a second digital filter circuit that is related to a deviation voltage between the second target voltage and the nonlinear detection signal voltage, and a second PID regulation circuit; and wherein when the downstream exhaust gas sensor is in its unactivated state, the second unactivation correction unit is selectively used in place of the downstream air fuel ratio control unit.

4. The vehicle mounted engine control apparatus as set forth in claim 1, wherein the program memory includes a control program that serves as the downstream and upstream activation detection units for the downstream and upstream exhaust gas sensors, and a control program that serves as the downstream and upstream inactive abnormality detection units for the downstream and upstream exhaust gas sensors, and a control program that serves as the downstream and upstream inactivity correction units for the downstream and upstream exhaust gas sensors;

wherein the downstream activation detection unit determines that the downstream exhaust gas sensor has been activated, by detecting when the detection signal voltage of the downstream exhaust gas sensor has changed from a lean level to a rich level, or from a rich level to a lean level;

wherein the downstream inactive abnormality detection unit determines that the downstream exhaust gas sensor is in an inactive abnormality, by detecting that the detection signal voltage of the downstream exhaust gas sensor has not changed from a lean level to a rich level, or from a rich level to a lean level even if a predetermined determination time has elapsed after electric power is supplied to the downstream heater;

wherein in response to the inactive abnormality detection unit having detected the inactive abnormality state of the downstream exhaust gas sensor, the downstream inactivity correction unit inputs a predetermined alternative signal voltage, in place of the first target voltage generated by the downstream air fuel ratio control unit, to the upstream air fuel ratio control unit;

wherein the upstream activation detection unit determines that the upstream exhaust gas sensor has been activated, by detecting when the detection signal voltage of the upstream exhaust gas sensor has changed from a lean level to a rich level, or from a rich level to a lean level;

wherein the upstream inactive abnormality detection unit determines that the upstream exhaust gas sensor is in an inactive abnormality, by detecting that the detection signal voltage of the upstream exhaust gas sensor has not changed from a lean level to a rich level, or from a rich level to a lean level even if a predetermined determination time has elapsed after electric power is supplied to the upstream heater; and wherein in response to the inactive abnormality detection unit having detected the inactive abnormality state of the upstream exhaust gas sensor, the upstream inactivity correction unit inputs a predetermined alternative signal voltage, in place of a correction command to increase or decrease the amount of fuel supply F generated by the upstream air fuel ratio control unit, to the fuel injection control unit.

5. The vehicle mounted engine control apparatus as set forth in claim 4, wherein the program memory includes the control program that serves as the downstream and upstream control abnormality detection units for the downstream and upstream air fuel ratio control units which operate at the time when the engine is not in a fuel cut operating state;

wherein the downstream control abnormality detection unit makes a determination that the downstream air fuel ratio control unit is abnormal, in cases where the state in which an output generated by the downstream air fuel ratio control unit is out of a predetermined upper and lower limit range continues over a predetermined time or more, and where the inactive abnormality detection unit for the downstream exhaust gas sensor does not detect any abnormality;

wherein the upstream control abnormality detection unit makes a determination that the upstream air fuel ratio control unit is abnormal, in cases where the state in which an output generated by the upstream air fuel ratio control unit is out of a predetermined upper and lower limit range continues over a predetermined time or more, and where the inactive abnormality detection unit for the upstream exhaust gas sensor does not detect any abnormality;

wherein in response to the downstream control abnormality detection unit having detected the abnormal state of the downstream air fuel ratio control unit, the downstream inactivity correction unit inputs a predetermined alternative signal voltage, in place of the first target voltage generated by the downstream air fuel ratio control unit, to the upstream air fuel ratio control unit; and wherein in response to the upstream control abnormality detection unit having detected the abnormal state of the upstream air fuel ratio control unit, the upstream inactivity correction unit inputs a predetermined alternative signal voltage, in place of the correction command to increase or decrease the amount of fuel supply generated by the upstream air fuel ratio control unit, to the fuel injection control unit.

6. The vehicle mounted engine control apparatus as set forth in claim 4, wherein the program memory includes a control program that serves as a learning storage unit;

wherein the learning storage unit stores an average value of a plurality of latest output values of the downstream air fuel ratio control unit or the upstream air fuel ratio control unit, which have been stored in a sequential manner, corresponding to at least one of the amount of intake air and the rotational speed of the internal combustion engine; and wherein an average value of measured data, which have been learned and stored by the learning storage unit during the time when the downstream and upstream exhaust gas sensors and the downstream and upstream air fuel ratio control units are operating in a normal manner, is applied as the alternative signal voltage which is applied in the downstream or upstream inactivity correction unit.

7. The vehicle mounted engine control apparatus as set forth in claim 4, wherein the program memory includes control programs that serve as inactivity determination correction units, and at least one pair of overcurrent abnormality detection units, deterioration detection units, and logic abnormality determination units, for the upstream and downstream heaters;

wherein the overcurrent abnormality detection units generate abnormality detection signals, respectively, in response to when a supply current to the upstream and downstream heaters detected by the current sensing resistors has exceeded a predetermined upper limit value, and open the upstream and downstream switching elements, respectively;

wherein the deterioration detection units generate abnormality detection signals, respectively, in response to when a supply current to the upstream and downstream heaters detected by the current sensing resistors has become less than a predetermined lower limit value;

wherein the logic abnormality determination units supervise logical compatibility between driving commands to the upstream and downstream switching elements, and logic supervisory signals responding to the conductive states of the upstream and downstream switching elements, and determine the presence or absence of an open circuit or short circuit abnormality of the upstream and downstream heaters, or the presence or absence of an open circuit or short circuit abnormality of the upstream and downstream switching elements; and wherein the inactivity determination correction units extend inactive abnormality determination times in the inactive abnormality detection units, respectively, in response to when the overcurrent abnormality detection units, or the deterioration detection units, or the logic abnormality determination units have detected abnormality.

8. The vehicle mounted engine control apparatus as set forth in claim 7, wherein a determination lower limit current in the deterioration detection units is corrected in such a manner that it becomes larger in proportion to a drive power supply voltage, which serves as a supply voltage to the upstream and downstream heaters.

9. The vehicle mounted engine control apparatus as set forth in claim 1, wherein the program memory includes a control program which serves as a delayed power supply time determination unit, and the delayed power supply time determination unit starts the supply of electric power to the downstream heater in response to when a current supplied to the upstream heater detected by the current sensing resistor has become equal to or less than a predetermined set threshold; and wherein the set threshold in the delayed power supply time determination unit is corrected in such a manner that it becomes larger in proportion to a drive power supply voltage, which serves as a supply voltage to the upstream heater.

10. The vehicle mounted engine control apparatus as set forth in claim 1, wherein the program memory includes a control program which serves as a heater voltage control unit;

wherein the heater control circuit is formed as a power module that includes at least the upstream and downstream switching elements; and wherein the heater voltage control unit suppresses an average supply voltage to at least the downstream heater by controlling the conducting duties of the switching elements so as to prevent the total current of the upstream and downstream heaters from exceeding a predetermined value, at the time when the supply of electric power to the downstream heater is started with attenuation of the current supplied to the upstream heater.

* * * * *